US011162325B2

(12) United States Patent
Tunes

(10) Patent No.: US 11,162,325 B2
(45) Date of Patent: Nov. 2, 2021

(54) WELL TOOL DEVICE WITH A BREAKABLE BALL SEAT

(71) Applicant: SBS TEchnology AS, Indre Arna (NO)

(72) Inventor: Kenneth Tunes, Bergen (NO)

(73) Assignee: SBS Technology AS

( * ) Notice: Subject to any disclaimer, the term of this patent is extended or adjusted under 35 U.S.C. 154(b) by 0 days.

(21) Appl. No.: 16/753,559

(22) PCT Filed: Oct. 25, 2018

(86) PCT No.: PCT/NO2018/050257
§ 371 (c)(1),
(2) Date: Apr. 3, 2020

(87) PCT Pub. No.: WO2019/083376
PCT Pub. Date: May 2, 2019

(65) Prior Publication Data

US 2020/0300059 A1 Sep. 24, 2020

(30) Foreign Application Priority Data

Oct. 25, 2017 (NO) ..... 20171709
Nov. 7, 2017 (NO) ..... 20171758

(51) Int. Cl.
*E21B 33/12* (2006.01)
*E21B 34/06* (2006.01)
*E21B 34/14* (2006.01)

(52) U.S. Cl.
CPC ..... *E21B 34/063* (2013.01); *E21B 33/1208* (2013.01); *E21B 34/142* (2020.05); *E21B 2200/04* (2020.05)

(58) Field of Classification Search
CPC .. E21B 33/1208; E21B 34/063; E21B 34/142; E21B 2200/04
See application file for complete search history.

(56) References Cited

U.S. PATENT DOCUMENTS 5,947,204 A * 9/1999 Barton ..... E21B 33/1295 166/317
8,220,538 B2 * 7/2012 Wee ..... E21B 33/134 166/179
10,544,653 B2 * 1/2020 Brandsdal ..... E21B 34/063
(Continued)

FOREIGN PATENT DOCUMENTS

GB 2311316 9/1997
WO WO2007108701 9/2007
(Continued)

*Primary Examiner* — Matthew R Buck
(74) *Attorney, Agent, or Firm* — Phillip Black; Dorsey & Jones PLLC

(57) ABSTRACT

A well tool device (1) comprising a housing (10) having a through channel (11) with a first end (11*a*) and a second end (11*b*), said housing (10) further comprises a breakable ball seat (15), wherein a drop ball (17) received in the ball seat (15) partially or fully closes fluid communication in the through channel (11) of the housing (10). The breakable ball seat (15) is made of brittle and/or tempered glass, wherein the ball seat (15) is broken by a pressure build up in the housing (10) forcing the ball seat (15) against one or more disintegrating means (16), said disintegrating means (16) are provided as inside protrusions in the through channel (11).

19 Claims, 21 Drawing Sheets

(56) References Cited

U.S. PATENT DOCUMENTS

| | | | | |
|---|---|---|---|---|
| 10,655,413 | B2 * | 5/2020 | Brandsdal | E21B 33/1208 |
| 10,883,328 | B2 * | 1/2021 | Brandsdal | E21B 29/00 |
| 2007/0295507 | A1 * | 12/2007 | Telfer | E21B 34/14<br>166/302 |
| 2009/0101358 | A1 * | 4/2009 | Bjorgum | E21B 47/117<br>166/376 |
| 2012/0125631 | A1 * | 5/2012 | Entchev | E21B 33/12<br>166/376 |
| 2016/0281455 | A1 * | 9/2016 | Brandsdal | E21B 33/12 |

FOREIGN PATENT DOCUMENTS

| | | |
|---|---|---|
| WO | 2017100417 | 6/2017 |
| WO | WO2017100417 | 6/2017 |

* cited by examiner

WELL TOOL DEVICE WITH A BREAKABLE BALL SEAT

FIELD OF THE INVENTION

The present invention relates to a well tool device comprising a housing having a through channel with a first end and a second end, said housing further comprises a breakable ball seat, wherein a drop ball received in the ball seat partially or fully closes fluid communication in the through channel of the housing.

BACKGROUND OF THE INVENTION

Ball seats are commonly used in downhole intervention and completion industry. A ball, dart or other activation device is normally used to activate a tool (circulation sleeve, frack sleeve or other), or to block a fluid flow. However, it is a common problem the ball seat will leave a restriction in the wellbore after it has served its purpose.

DISCLOSURE OF THE STATE OF ART

One prior solution involves mill out of metallic ball seats. This requires intervention in the well either by tractor or coiled tubing. This is time consuming, costly and risky. Another prior solution involves ball seats made from dissolvable/degradable materials. This requires a certain fluid and temperature present in the well, and it will also take some time to dissolve the seat. Other prior solutions are collets used as ball seats. This has limitations to how much the inner diameter can change when manipulating the collet, hence it will often leave a restriction in the well, and it is also difficult to obtain a hydraulic seal in a collet.

US2012205120 A1 disclose a method of servicing a subterranean formation comprising providing a first sleeve system comprising a first one or more ports and being transitionable from a first mode to a second mode and from the second mode to a third mode, and a second sleeve system comprising a second one or more ports and being transitionable from a first mode to a second mode and from the second mode to a third mode, wherein, in the first mode and the second mode, fluid communication via the one or more ports of the first or second sleeve system is restricted, and wherein, in the third mode, fluid may be communicated via the one or more ports of the first or second sleeve system, transitioning the first and second sleeve systems to the second mode, and allowing the first sleeve system to transition from the second mode to the third mode. In an alternative embodiment, a segmented seat, of for instance ceramics, may be configured to disintegrate when acted upon by an obturator. A protective sheath keeps the segments of the seat together, which are allowed to fall down in a larger diameter area when the protective sheath is broken.

US2001045288 A1 disclose a drop ball sub that may be used to drop a large ball having an outer diameter larger than the inner diameter of a restriction in the wellbore such as the running tool used to run a first casing string through a second casing string. A smaller ball is used to control dropping of the large ball. The smaller ball has an outer diameter smaller than the restriction. The drop ball sub may be used to operate any downhole tool that would benefit by receipt of a large ball. By dropping a larger ball, in one use larger valves can be controlled in the float equipment that provides a larger fluid flow path. A larger fluid flow path reduces surge pressure and enables the system to handle more debris. The system preferably provides for a diverter tool above the running tool and a diverter tool below the running tool. The use of the upper diverter in conjunction with the lower diverter tool permits fluid flow into the second casing string to reduce back pressure and provide a large volume flow path.

EP2290192 A1 discloses equipment for servicing subterranean wells. Particularly a bottom cementing plug that is equipped to activate autofill float equipment, and a method by which the plug is employed to activate autofill equipment. The bottom cementing plug contains an activation device that is released when the plug lands on the autofill equipment, and then enters the autofill equipment, triggering the activation of check valves. The activation device may also contain a chemical substance that is released into the well when the activation device exits the bottom cementing plug.

WO2017100417 A1 discloses a casing segmentation device and system, and a method for selectively providing a fluid flow passage through a casing segmentation device disposed within a well casing segment is provided. The casing segmentation device includes a body and a fracture mechanism. The body has a forward end, an aft end, a plug seat, and an internal passage. The plug seat is configured to receive a mating plug. The internal passage extends between the forward end and the aft end and through the plug seat. The fracture mechanism includes an amount of energetic material and a trigger mechanism. The trigger mechanism is configured to selectively cause a detonation of the amount of energetic material.

WO2007108701 A1 discloses a decomposable sealing device is described for use in liquid-filled pipes or boreholes, which is characterized in that the sealing device comprises a sleeve-shaped element which envelops a number of strata completely or partly in the pipe's radial and a longitudinal direction, comprising layered division of a number of decomposable strata and a number of closed liquid-filled chambers arranged between the strata and where the sleeve-shaped element comprises a body which can be rearranged to establish connection between the respective chambers and one or more grooves in the inner wall of a pipe. A method for decomposing the sealing device is also described.

GB2311316 A discloses tools for use in wellbores which are actuated by means of actuating balls. The invention provides a method of actuating a tool located in a wellbore, the method comprising the sequential steps of: (a) locating a frangible actuating ball on a seat, the seat being provided in the tool for receiving the actuating ball, (b) pumping fluid down a tubing string attached to the tool so as to apply a force to the seat and thereby actuate the tool, the force being transmitted to the seat through the actuating ball; and (c) breaking the actuating ball to permit fluid to flow through the seat. The invention has the advantage over the prior art of providing means for actuating a downhole tool with an actuating ball so that the actuating ball does not form an undesirable obstruction once the tool has been actuated.

Reference is further made to U.S. Pat. No. 5,960,881 A, US2011240315 A1, CN87216722 U and US2003047320 A1.

None of the above prior art documents disclose use of a ball seat of glass.

OBJECTS OF THE PRESENT INVENTION

The present invention can be used in several configurations, for instance:

Tubing pressure test/packer setting device.

Tubing to annulus circulation—shifting from open to closed.

Tubing to annulus circulation—shifting from closed to open, typical for tracking applications.

Tubing to annulus circulation—open ports by shattering glass.

Tubing to annulus multicycle—shifting from open to closed to open to closed, by for instance utilizing two crushable ball seats in different size.

For shifting/activating flapper valve.

Activation device for 3rd party device.

Other applications are also possible.

It thus an object of the present invention to provide a well tool for use in downhole intervention and completion, and particularly a well tool with a ball seat made of a brittle material that can be shattered, such as glass, immediately post activation, or as a part of the activation process, forming a hydraulic seal, and leaving no restrictions in the wellbore post shattering.

A major advantage with using glass compared to for instance ceramics is that the glass will be shattered in very small fragments or pieces compared to ceramics. In an oil well it is important not to have large fragments, as it can cause problems for other equipment that is used in the well. The shattered glass fragments can be produced to the surface without having any other effect than normal sand production from the well.

SUMMARY OF THE INVENTION

Said object are achieved with a well tool device comprising a housing having a through channel with a first end and a second end, said housing further comprises a breakable ball seat, wherein a drop ball received in the ball seat partially or fully closes fluid communication in the through channel of the housing. The breakable ball seat is made of brittle and/or tempered glass, wherein the ball seat is broken by a pressure build up in the housing forcing the ball seat against one or more disintegrating means, in where said disintegrating means are provided as inside protrusions in the through channel.

The housing can comprise an axially movable sleeve, and the ball seat is seated in the sleeve.

The sleeve can comprises one or more longitudinally slots for receipt of the inside protrusions of the disintegrating means.

The breakable ball seat can be donut shaped.

The disintegrating means can comprise one or more pins mounted inside the housing and which are protruding inwardly in the through channel.

After the drop ball is received in the ball seat and fluid communication in the through channel of the housing is partially or fully closed, the sleeve can be shifted axially in the housing by the pressure build up to close or open ports in the housing.

The drop ball can be dissolvable.

Further, the disintegrating means can comprise one or more pins protruding inwardly on the inside of the sleeve, wherein the pressure build up forces the ball seat against the disintegrating means to shatter the ball seat.

The disintegrating means can comprise one or more pins protruding axially in the through channel of the housing, wherein the pressure build up forces the ball seat against the disintegrating means to shatter the ball seat.

The housing can comprise a first and a second house part connected to each other, and the ball seat can located adjacent an internal end of the first house part and the one or more pins of the disintegrating means can protrude axially from an internal end of the second house part.

A ring shaped disk can be placed adjacent the disintegrating means, said ring shaped disk being arranged to break at a predetermined breaking pressure.

The breakable ball seat can be made of one piece of glass, or the breakable ball seat can be made of several pieces of glass. The pieces of glass can be separated by an intermediate material layer other than glass.

Said material layer can be a gasket or similar.

The housing may further comprise resistance means holding the sleeve with the ball seat in place during pressure testing of the well.

The resistance means can be shear pins or a shear ring holding the sleeve with the ball seat in place, and where the shear pins or ring have a shear resistance higher than a test pressure.

In another embodiment, the resistance means can comprise a counter and a release mechanism, which after the counter has counted a number of pressure pulses is released to allow movement of the sleeve with the ball seat.

The release mechanism can be a retractable release piston embedded in the sleeve, which after the counter has counted a number of pressure pulses is released.

The counter can be placed on the pressurized side of the ball seat and the retractable release piston can be placed on the non-pressurized side of the ball seat, and said counter and the retractable release piston are connected to each other by a pressure line.

DESCRIPTION OF THE DIAGRAMS

Embodiments of the present invention will now be described, by way of example only, with reference to the following diagrams wherein:

FIG. 1 shows a first embodiment of the invention.

FIG. 2*a*-2*d* show operation of the first embodiment of the invention.

FIG. 3*a*-3*b* show application of the first embodiment of the invention.

FIG. 4 shows a second embodiment of the invention.

FIG. 5*a*-5*d* show operation of the second embodiment of the invention.

FIG. 6*a*-6*b* show application of the second embodiment of the invention.

FIG. 7 shows a third embodiment of the invention.

FIG. 8*a*-8*d* show operation of the third embodiment of the invention.

FIG. 9*a*-9*c* show application of the third embodiment of the invention.

FIG. 10 shows a fourth embodiment of the invention.

FIG. 11*a*-11*c* show operation of the fourth embodiment of the invention.

FIG. 12 shows a fifth embodiment of the invention.

FIG. 13*a*-13*h* show operation of the fifth embodiment of the invention.

FIG. 14*a*-14*b* and 15*a*-15*b* show application of the fifth embodiment of the invention.

FIG. 16 shows a sixth embodiment of the invention.

FIG. 17*a*-17*e* show operation of the sixth embodiment of the invention.

FIG. 18*a*-18*b* show application of the sixth embodiment of the invention.

DESCRIPTION OF PREFERRED EMBODIMENTS OF THE INVENTION

Figure 1:
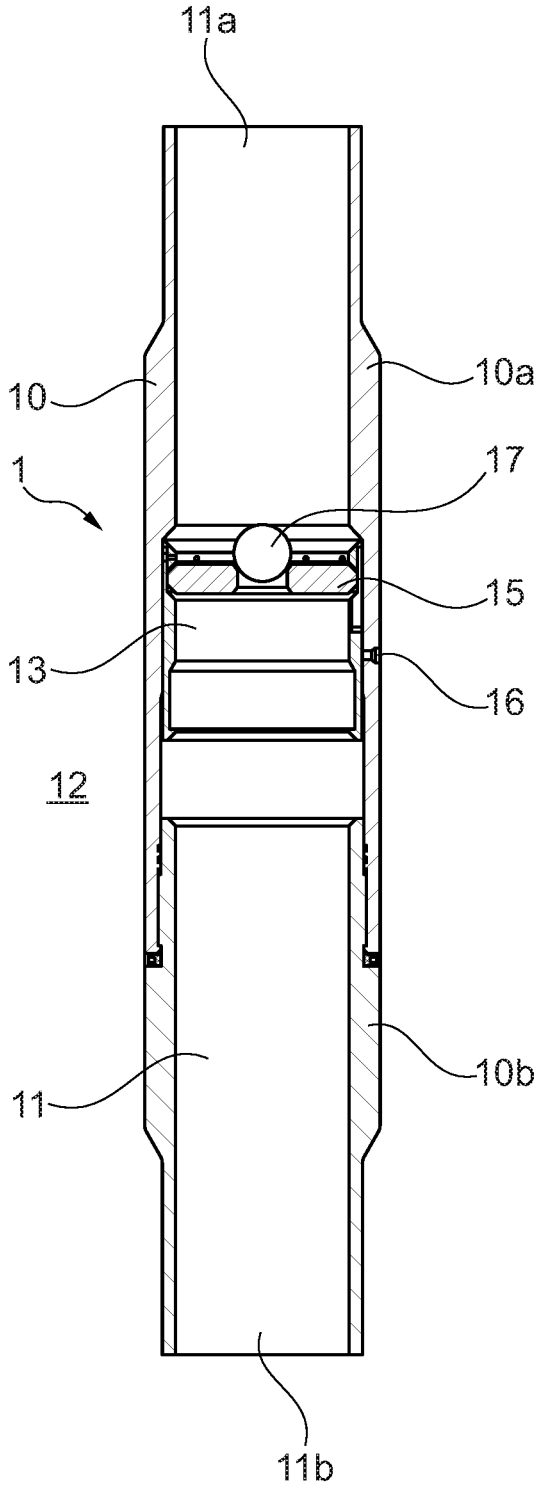

As apparent from the drawings, the present invention relates to a well tool device 1 comprising a housing 10 having a through channel 11 with a first end 11*a* and a second end 11*b*. The housing 10 may consist of two house parts 10*a*, 10*b*, wherein the first end 11*a* is provided in the first house part 10*a* and the second end 11*b* is provided in the second house part 10*b*.

The housing 10 further comprises a breakable ball seat 15, wherein a drop ball 17 received in the ball seat 15 partially or fully closes fluid communication in the through channel 11 of the housing 10. The breakable ball seat 15 is made of glass, and the ball seat 15 is broken by a pressure build up in the housing 10 forcing the ball seat 15 against one or more disintegrating means 16.

The drop ball 17 can be a ball, dart or other obturator or activation device normally used to activate a tool (circulation sleeve, frack sleeve or other), or to block a fluid flow, used in downhole intervention and completion industry. The ball seat 15 may thus be shaped according to the particular activation device used.

The breakable ball seat 15 can be made of brittle and/or tempered glass, and may be donut shaped to accommodate the drop ball 17. The drop ball 17 can for instance be dissolvable or degradeable, and be made of for instance Magnesium, Aluminum, or alloys combining the two and also other materials in the group of "degradeables".

In some cases, it is desirable to perform pressure testing in the well against the ball seat 15. During such a pressure test, the ball seat must be held in place and not break. During such a pressure test, pressure should be built up over the ball seat one or several times, prior to the ball seat 15 being broken by the pressure build up in the housing 10 forcing the ball seat 15 against the disintegrating means 16. The housing 10 of the well tool device 1 may thus be equipped with resistance means to assist in the ball seat 15 being able to withstand the pressure build up during the pressure testing.

Such resistance means may for instance be shear pins or a shear ring 22 that break based on the pressure build up. As seen in FIG. 19*b* the shear pins 22 or shear ring can be embedded in the sleeve 13. The shear pins or shear ring 22 can have a shear resistance higher than the test pressure, and which when broken allows axial movement of the sleeve 13 with the ball seat 15.

Figure 19A:
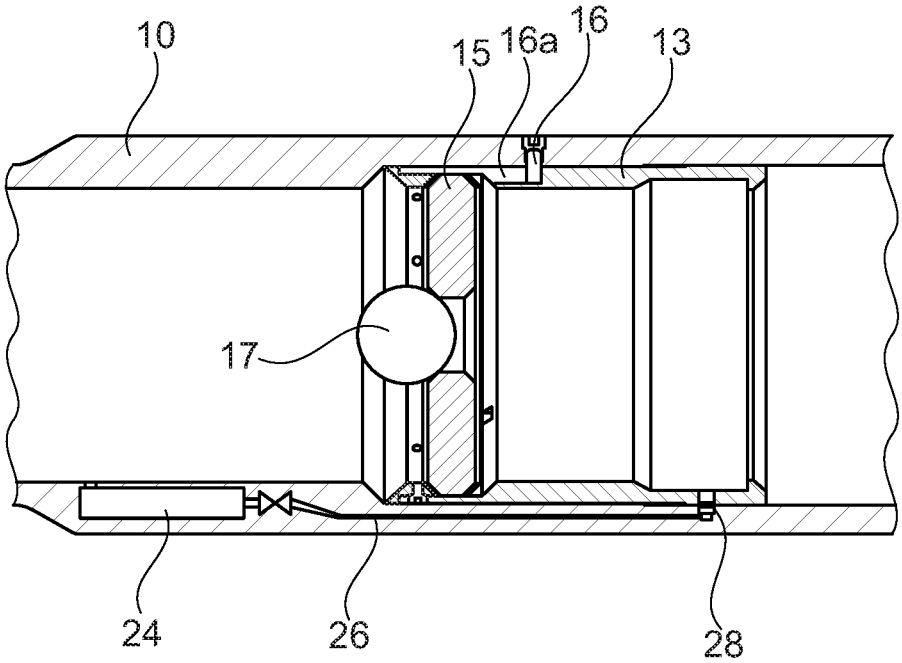
FIG. 19 shows a first embodiment of a breakable ball seat.
Figure 19B:
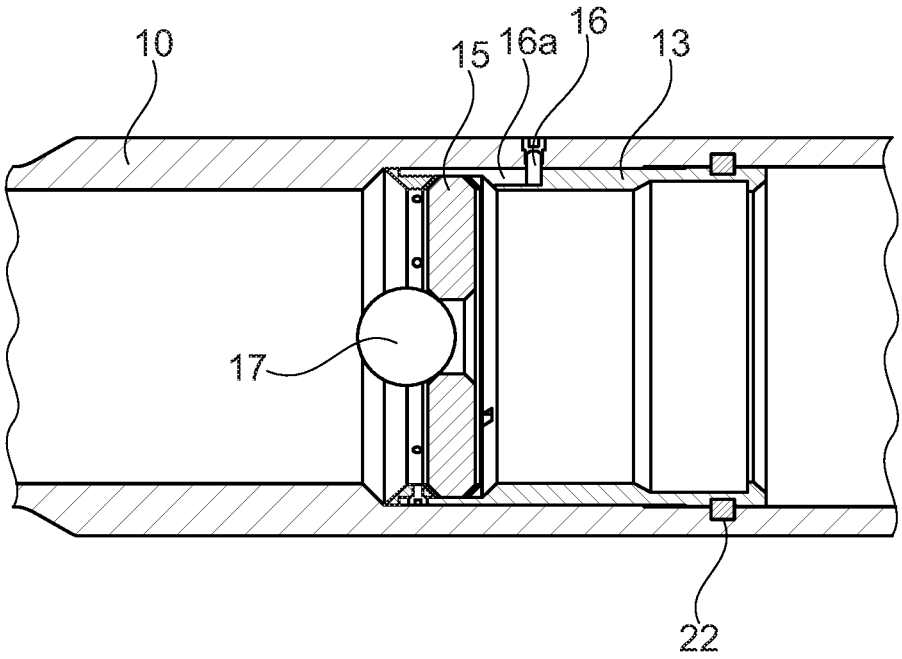

In another embodiment, as shown in FIG. 19*a*, the resistance means can be a release mechanism 28, which retracts after a counter 24 has counted a number of pressure pulses, prior to the ball seat 15 being released. The release mechanism may for instance be one or more retractable pistons 28 connected to the counter 24 by a pressure line 26. The counter 24 is placed on the pressurized side (or more correctly on the side that shall be pressurized) of the ball seat 15 and counts pressure pulses. When a desired number of pulses are reached, the pressure line 26 is pressurized to retract the one or more retractable pistons, thereby allowing axial movement of the sleeve 13 with the ball seat 15.

Figure 20:
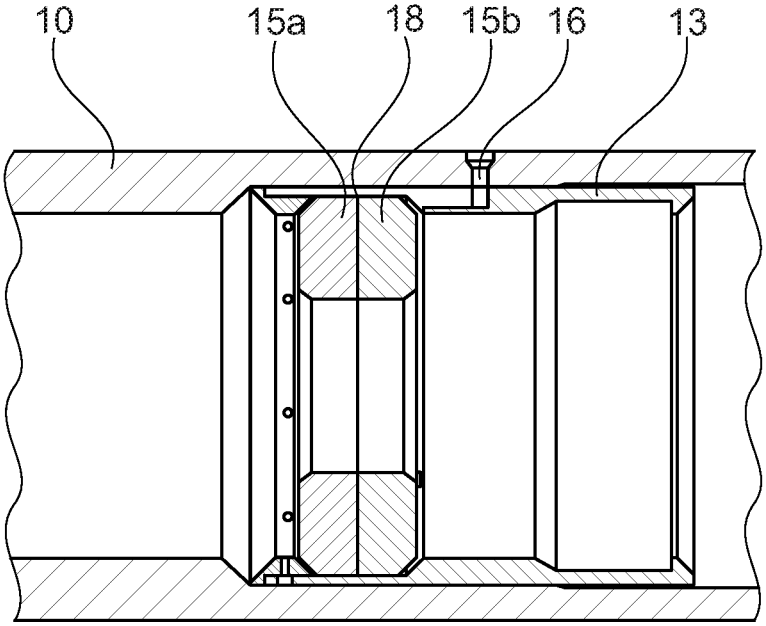
FIG. 20 shows a second embodiment of a breakable ball seat.

FIGS. 19*a* and 19*b* shows a first embodiment of a breakable ball seat 15, and which is made in one piece of glass. FIG. 20 shows a second and alternative embodiment of a breakable ball seat 15, and which is made of two pieces of glass 15*a*, 15*b*. The two pieces of glass 15*a*, 15*b* are separated by a gasket 18, liner or material layer other than glass. The gasket 18 will prevent glass-to-glass contact between the two pieces of glass 15*a*, 15*b*, and thus prevent damage to the glasses. More than two pieces of glass can be used, in where the pieces similarly are separated by gaskets 18 or similar. Using several pieces of glass will increase the strength of the ball seat 15, allowing it to withstand higher pressure. The ball seat 15 will then also be more resilient against impact. To further increase impact resistance, the side of the ball seat 15 receiving the ball 17 can comprise or be covered by a material layer other than glass.

FIG. 1 shows a first embodiment of the invention. As shown, the present invention relates to a well tool device 1 comprising a housing 10 having a through channel 11 having a first end 11*a* and a second end 11*b*. The house has an outside 12. A sleeve 13 is provided in the housing. A crushable shoulder or ball seat 15 is provided at least partially within the sleeve 13, together with a disintegrating (crushing) means 16. As seen in FIG. 2*a*-2*d*, the sleeve 13 is configured to be pushed/activated by the drop ball 17 that is released into the well stream and pumped down to land on the ball seat 15 and creating a full or partial seal of the through channel 11. By landing the ball in the ball seat 15 the pressure can be built up above the formed plug (ball seat 15 and the landed ball 17). This pressure can be utilized for activities like tubing integrity testing or for activation of production packer. By further increasing the differential pressure over the ball seat 15 and the ball 17 this will push the sleeve 13 from initial to end position. At the end of the axial movement the ball seat 15 is broken by the disintegrating means 16. When the ball seat 15 is disintegrated, full and unrestricted flow can happen in the through bore 11.

The disintegrating means 16 are provided as inside protrusions in the through channel 11. In the embodiments of particularly FIG. 1 ,4, 7 and possible also FIG. 16, the axially movable sleeve 13 comprises one or more longitudinally slots 16*a*, cavities or similar, for receipt of the inside protrusions of the disintegrating means 16, said slots 16*a* allowing axial movement of the sleeve 13 with the ball seat 15 towards the disintegrating means 16 due to the pressure build up.

Figure 2A:
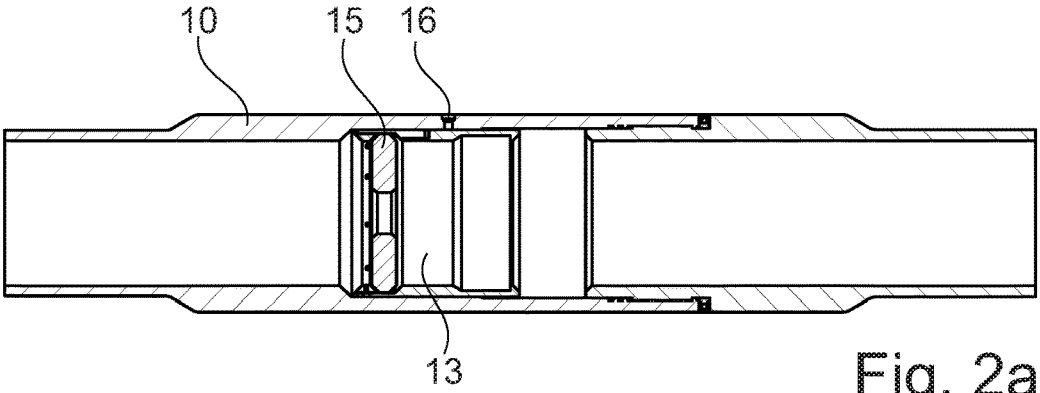
Figure 2B:
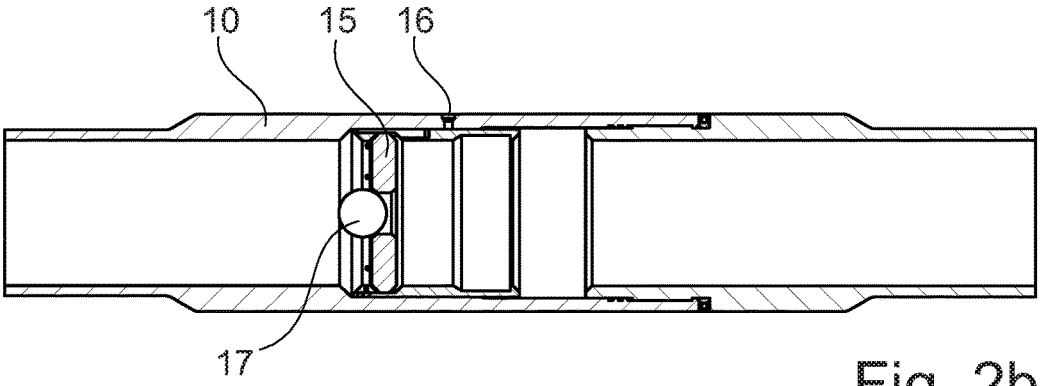
Figure 2C:
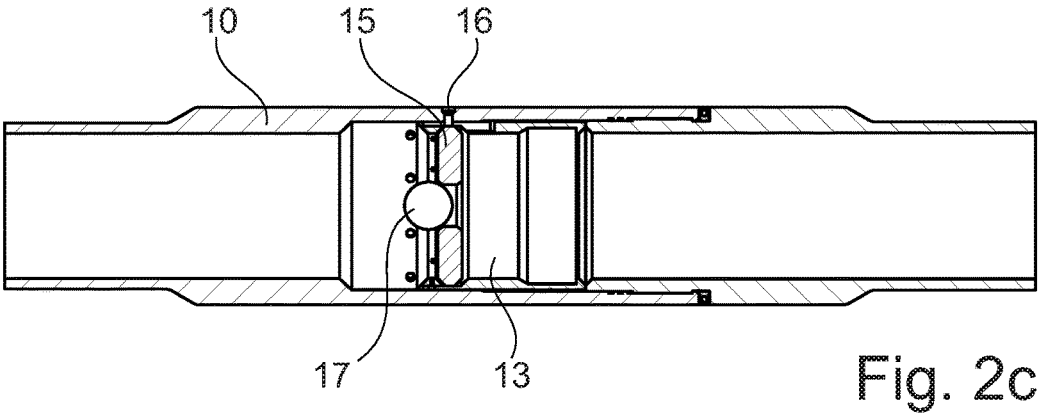
Figure 2D:
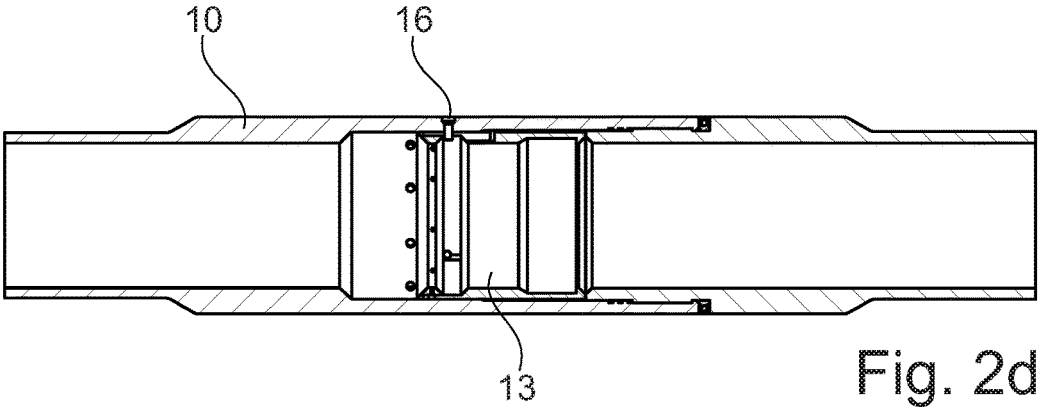

FIG. 2*a* shows the housing 10 being run in hole. In FIG. 2*b*, the drop ball 17 is landed in the ball seat 15 and test tubing and/or set packer is performed. In FIG. 2*c* pressure is increased to shift the sleeve 13 axially such that the ball seat 15 is pushed against the disintegrating means 16 and shattered. FIG. 2*d* shows that the ball seat 15 is shattered.

Figure 3A:
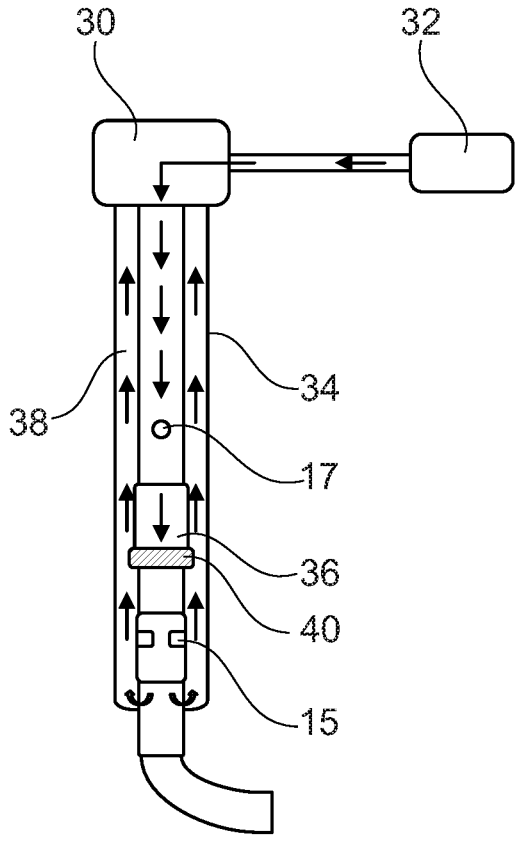
Figure 3B:
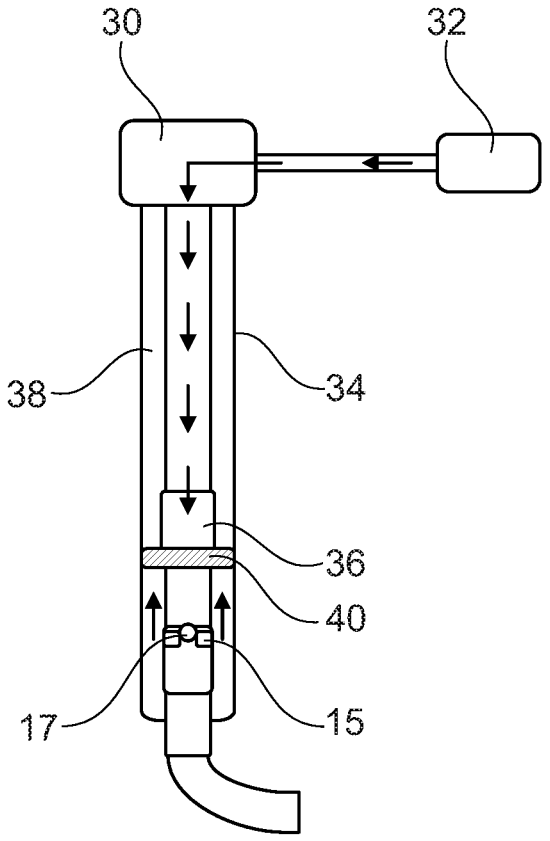

FIG. 3*a*-3*b* show application of the first embodiment of the invention. Reference number 30 indicate the rig and reference number 32 indicate a pump. FIG. 3*a* shows that the tubing 36 has been run into the hole 34 and fluid is being circulated between tubing 36 and annulus side 38, and the drop ball 17 is being dropped into the tubing 36 and flows with the fluid flow in the tubing. In FIG. 3*b*, the drop ball 17 has landed in the ball seat 15 and the production packer 40 is set. Thereafter the ball seat 15 is shattered/broken and unrestricted flow is permitted in the tubing 36.

The first embodiment is particularly suited for building up pressure in the tubing 36, used for instance during tubing pressure test/packer setting device.

Figure 4:
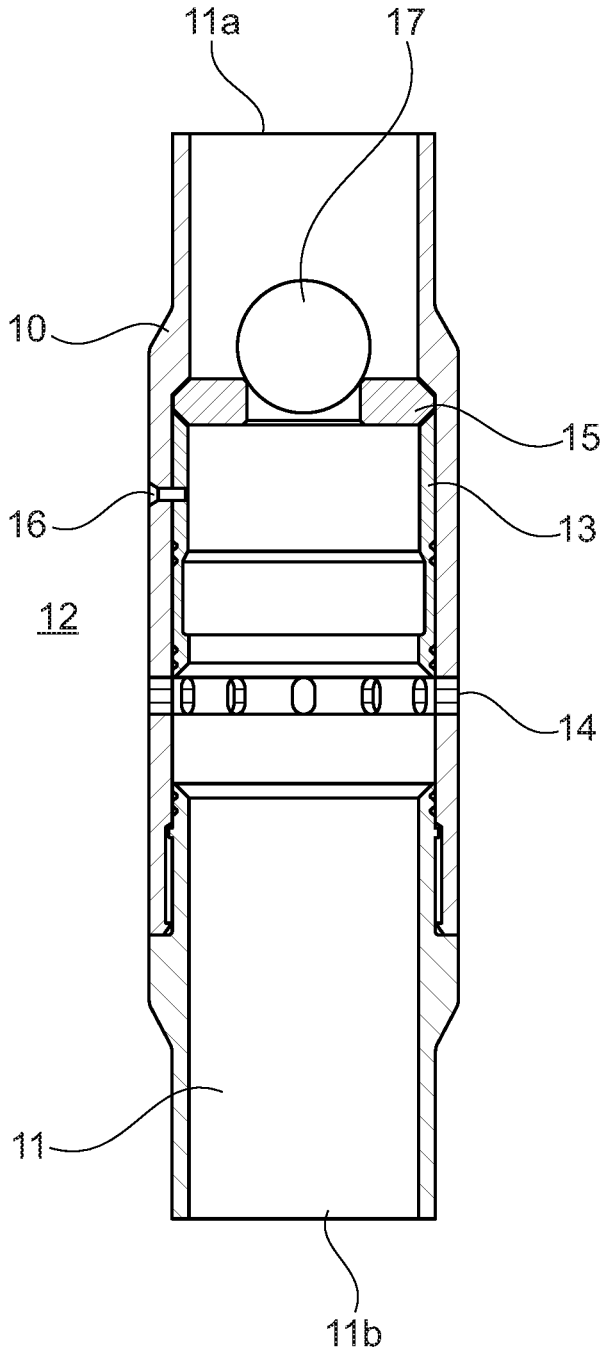

FIG. 4 shows a second embodiment of the invention. The second embodiment of the well tool is basically similar to the first embodiment, but in the housing 10 there are one or more radial ports 14 connecting the through channel 11 with the outside of the housing 12. The sleeve 13 is provided in the housing, and the ball seat 15 is provided at least partially within the sleeve 13. The sleeve 13 can be slid in the axial direction so that the port(s) 14 are covered and thus closes the communication between the through channel 11 and the outside of the housing 12. The sleeve 13 is configured to be pushed/activated by the drop ball 17 that is released into the well stream and pumped down to land on the ball seat 15 and creating a full or partial seal of the through channel 11. By creating a differential pressure over the ball seat 15 and the ball 17 this will push the sleeve 13 from open to closed position thereby closing communication between through channel 11 and outside of housing 12. After the sleeve has closed the port(s) 14 it can then be axially pushed so that ball seat 15 is broken by the disintegrating means 16. When the sleeve has closed the port(s) 14 and the ball seat 15 is disintegrated, full and unrestricted flow can happen in the through bore 11.

Figure 5A:
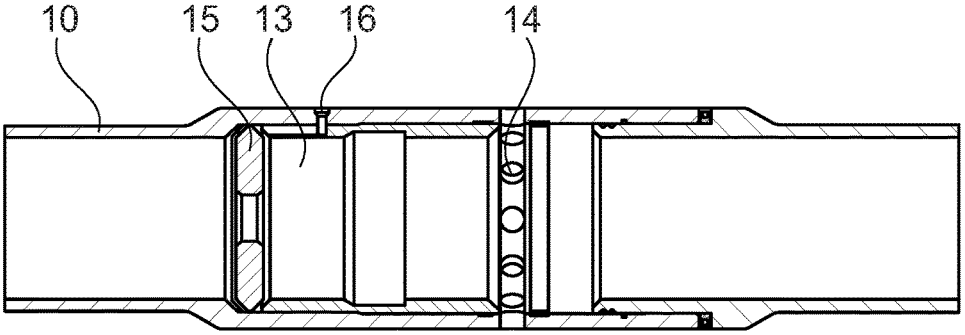
Figure 5B:
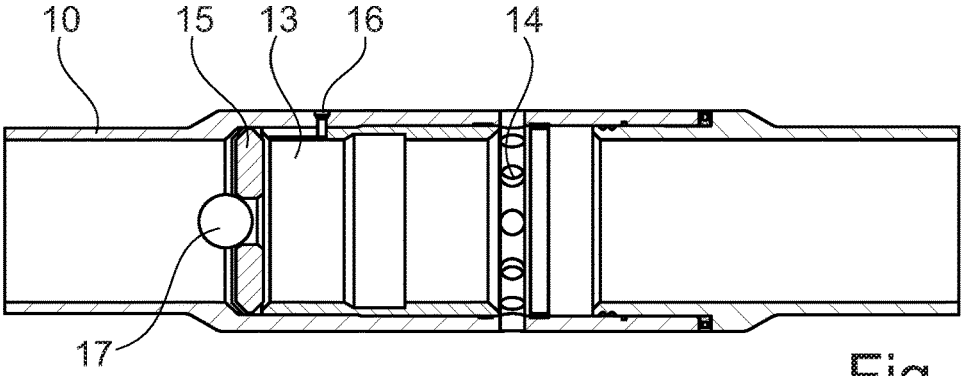
Figure 5C:
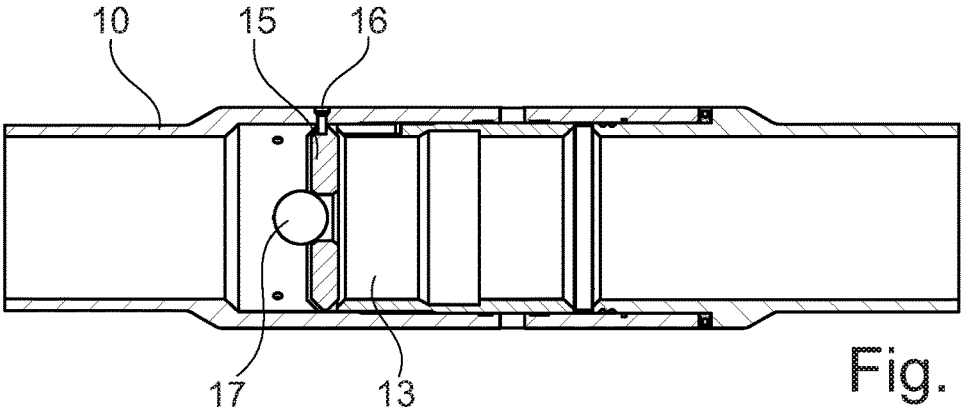
Figure 5D:
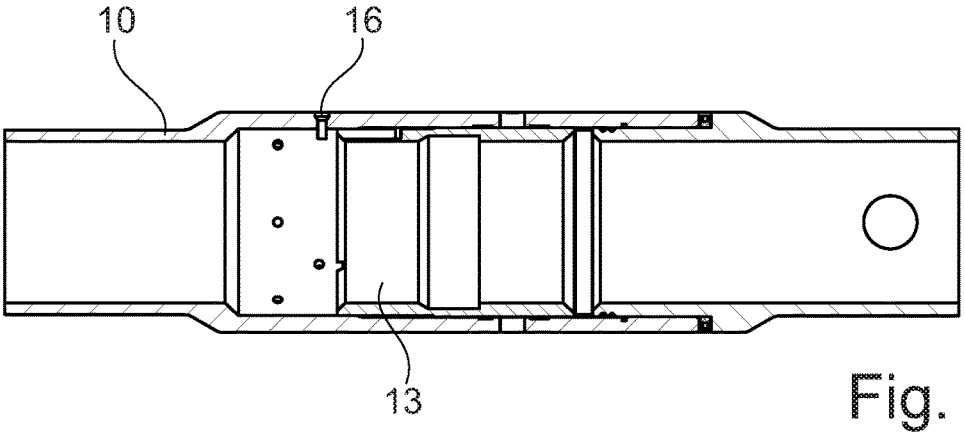

FIG. 5*a* shows the housing 10 being run in hole, and the ports 14 are open. In FIG. 5*b*, the drop ball 17 has landed in the ball seat 15 and pressure is increased to shift the sleeve 13 axially such that the ports 14 are closed (FIG. 5*c*). The ball seat 15 is pushed against the disintegrating means 16 and shattered. FIG. 5*d* shows that the ball seat 15 is shattered.

Figure 6A:
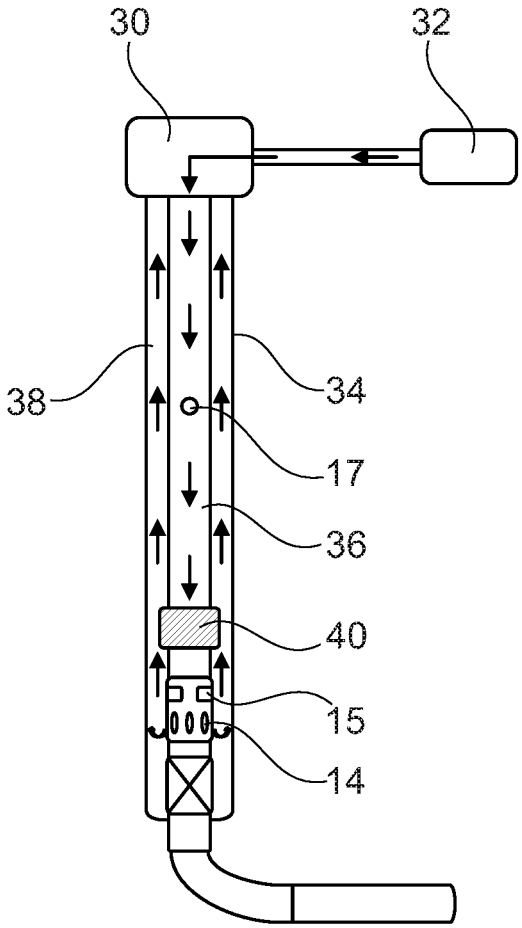
Figure 6B:
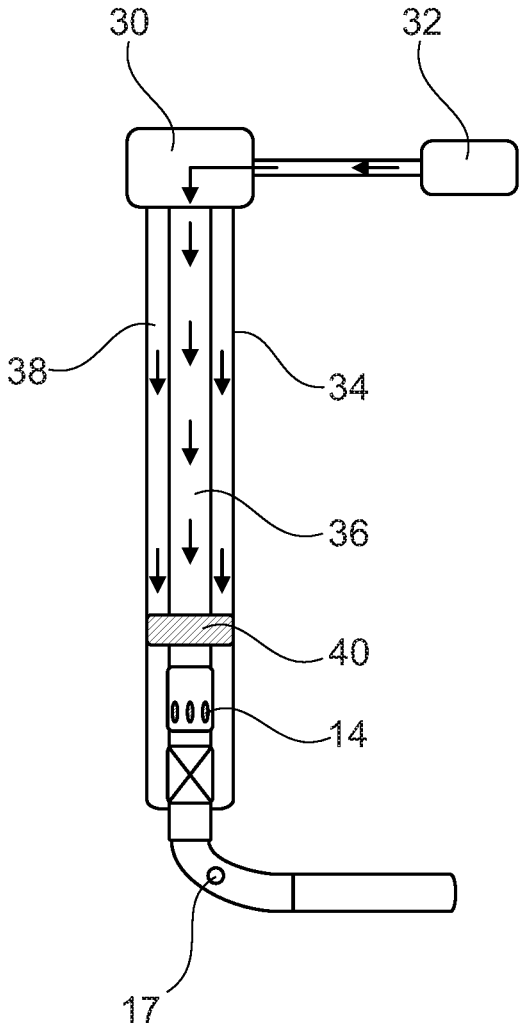

FIG. 6*a*-6*b* show application of the second embodiment of the invention. As disclosed above, 30 indicate the rig and 32 indicate a pump. FIG. 6*a* shows that the tubing 36 has been run into the hole 34 and fluid is being circulated between tubing 36 and annulus side 38 through the open ports 14, and the drop ball 17 is being dropped into the tubing 36 and flows with the fluid flow in the tubing. FIG. 6*b* shows that the ball seat 15 is shattered/broken and the production packer 40 is set. The drop ball 17 flows further in the tubing.

The second embodiment is particularly suited for closing the tubing 36, used for instance during tubing to annulus circulation for shifting from open to closed.

Figure 7:
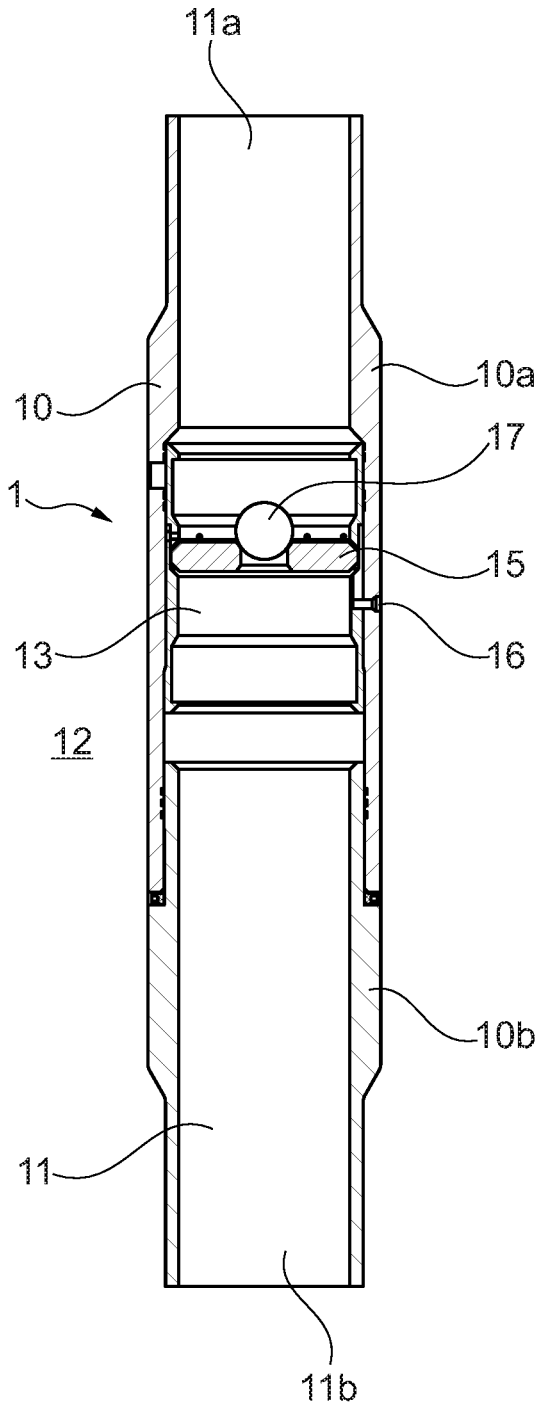

FIG. 7 shows a third embodiment of the invention. The third embodiment of the well tool is basically similar to the second embodiment, but the sleeve 13 is shifted to open the one or more radial ports 14 connecting the through channel 11 with the outside of the housing 12. The sleeve 13 can be slid in the axial direction so that the port(s) 14 are uncovered and thus opens the communication between the through channel 11 and the outside of the housing 12. The sleeve 13 is configured to be pushed/activated by the drop ball 17 that is released into the well stream and pumped down to land on the ball seat 15 and creating a full or partial seal of the through channel 11. By creating a differential pressure over the ball seat 15 and the ball 17 this will push the sleeve 13 from closed to open position thereby opening communication between through channel 11 and the outside of housing 12. After the sleeve 13 has opened the port(s) 14, it can then be axially pushed so that the ball seat 15 is broken by the disintegrating means 16. When the sleeve has opened the port(s) 14 and the ball seat 15) is disintegrated, full and unrestricted flow can happen in the through bore 11.

Figure 8A:
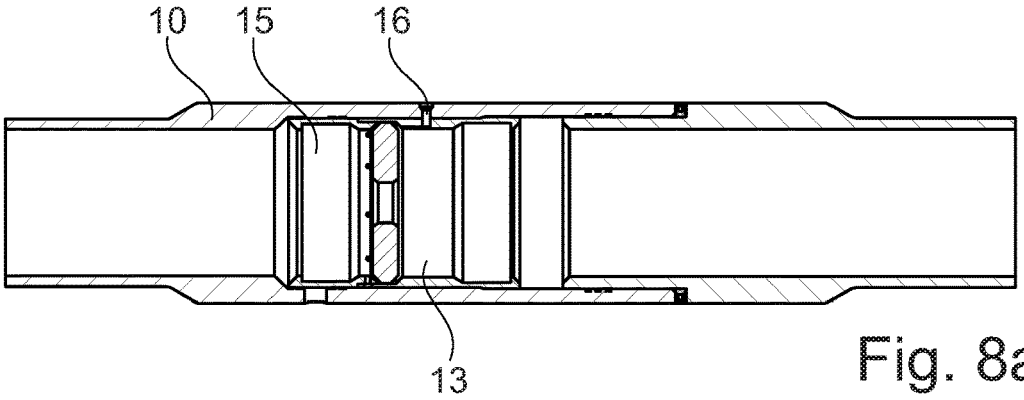
Figure 8B:
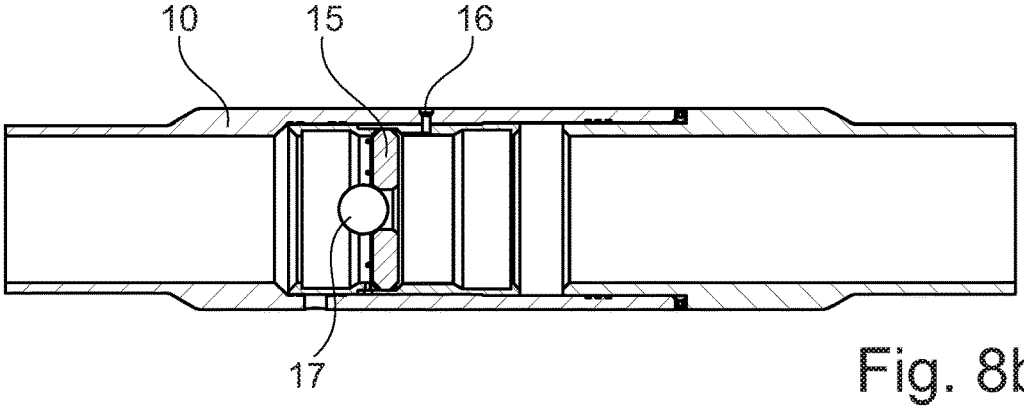
Figure 8C:
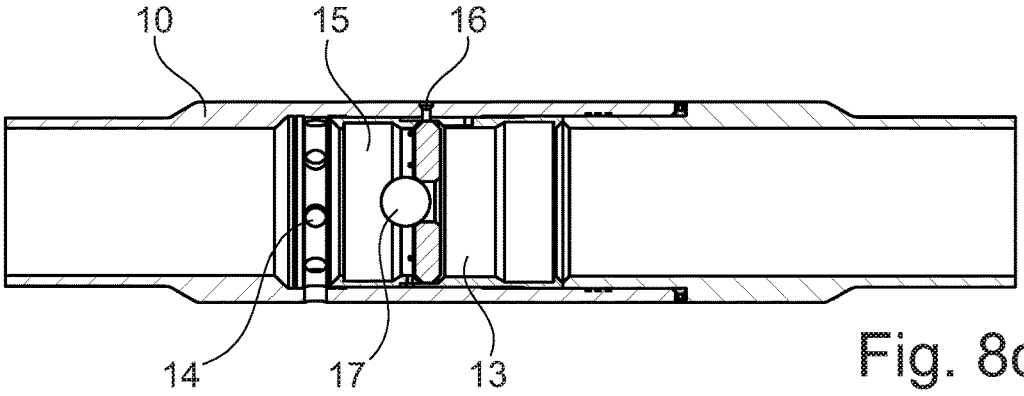
Figure 8D:
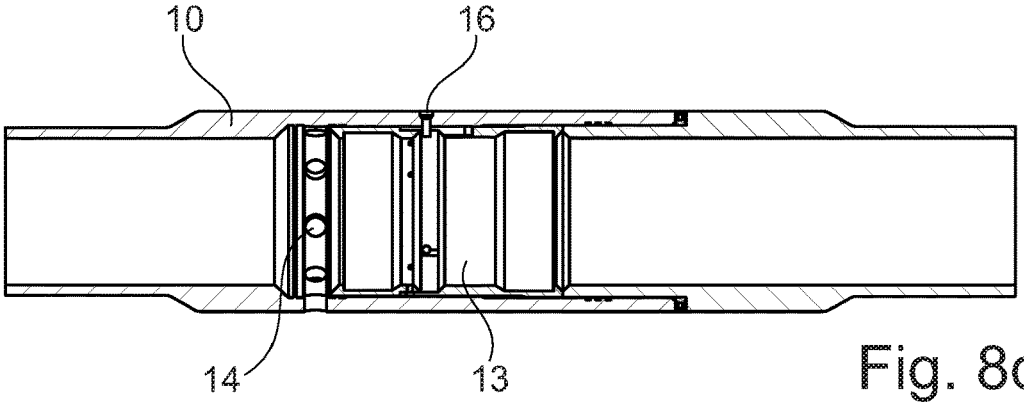

FIG. 8*a* shows the housing 10 being run in hole, and the ports 14 are closes. In FIG. 8*b*, the drop ball 17 has landed in the ball seat 15 and pressure is increased to shift the sleeve 13 axially such that the ports 14 are opened (FIG. 8*c*). The ball seat 15 is pushed against the disintegrating means 16 and shattered. FIG. 8*d* shows that the ball seat 15 is shattered.

Figure 9A:
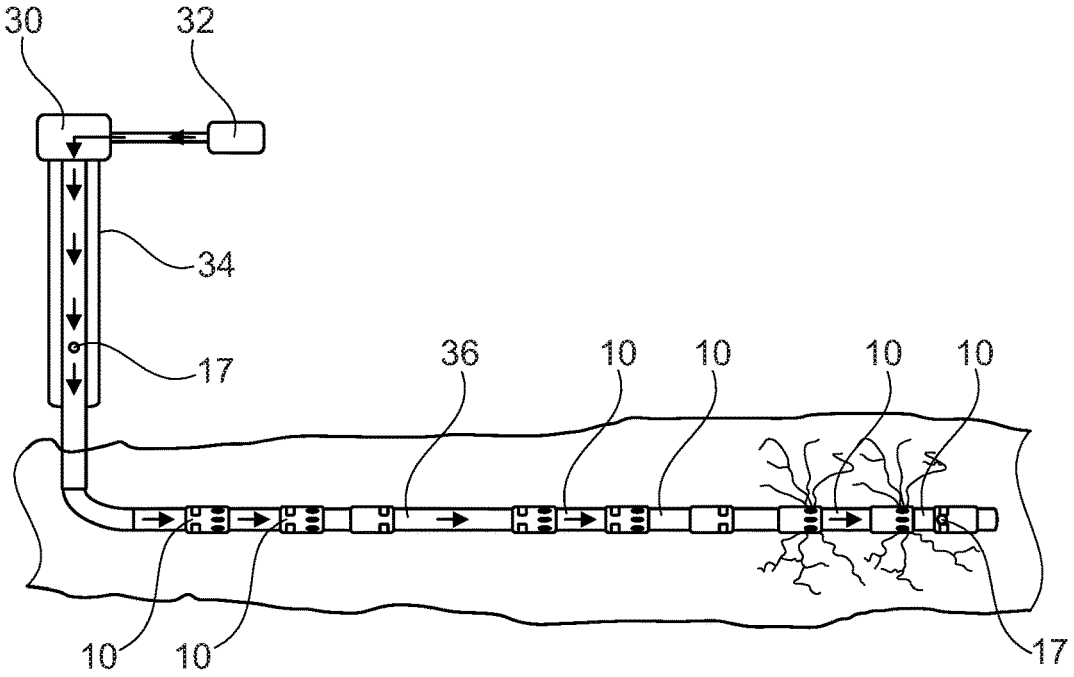
Figure 9B:
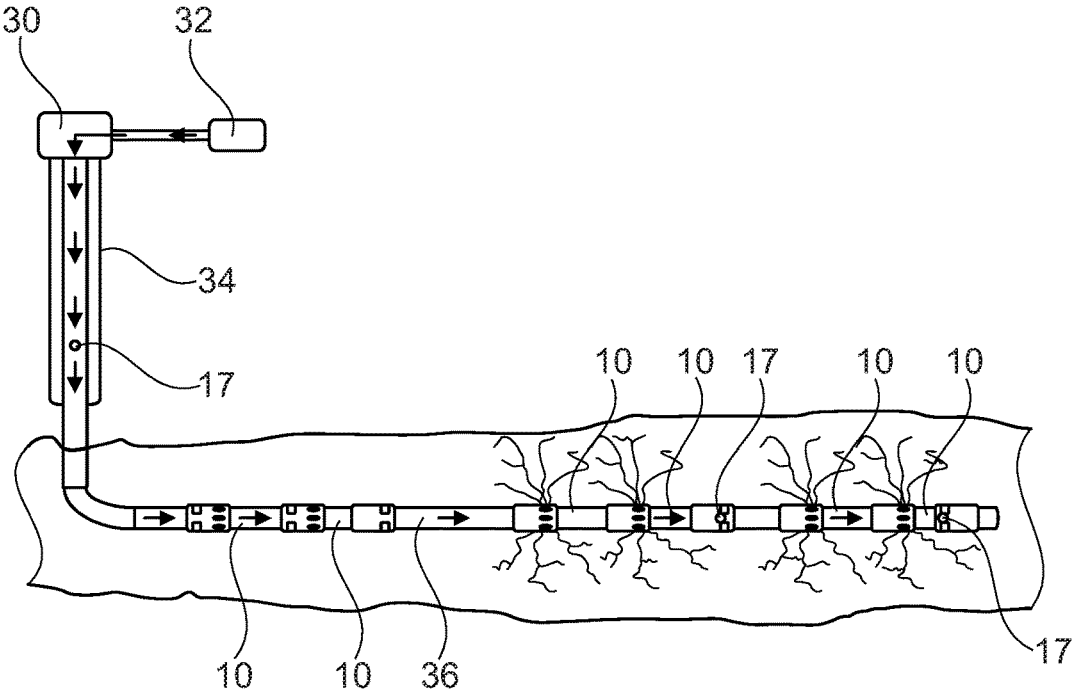
Figure 9C:
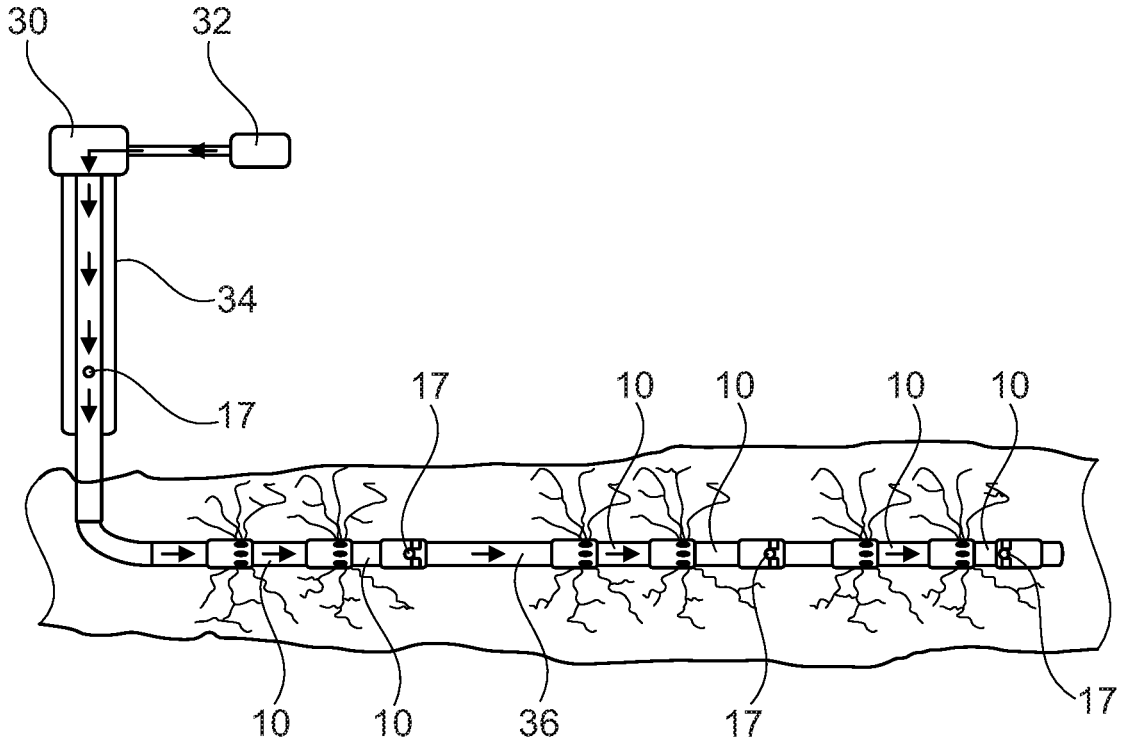

FIG. 9*a*-9*c* show application of the third embodiment of the invention. As disclosed above, 30 indicate the rig and 32 indicate a pump, for instance a fracking pump. The tubing 36 comprises several housings 10 for fracking different zones in the formation. In FIG. 9*a*, a drop ball 17 of relative small diameter size is dropped into the well stream to open the ports 14 of two distal housings 10 for fracking of a first zone. In FIG. 9*b*, a drop ball 17 of relative medium diameter size is dropped into the well stream to open the ports 14 of two housings 10 placed upstream of the distal housings 10, for fracking of a second zone. In FIG. 9*c* a drop ball 17 of relative larger diameter size is dropped into the well stream to open the ports 14 of two housings 10 placed upstream of the other housings 10, for fracking of a third zone. Thus, a number of housings 10 with ball seats 15 with similar or different ball seat internal diameter can be placed adjacent or separated from each other.

Small, medium and larger refer to the size of the drop ball compared to each other, The same applies for the internal diameter of the ball seats receiving the drop balls.

The third embodiment is particularly suited for opening the tubing 36, used for instance during tubing to annulus circulation for shifting from closed to open, typical for fracking applications.

Figure 10:
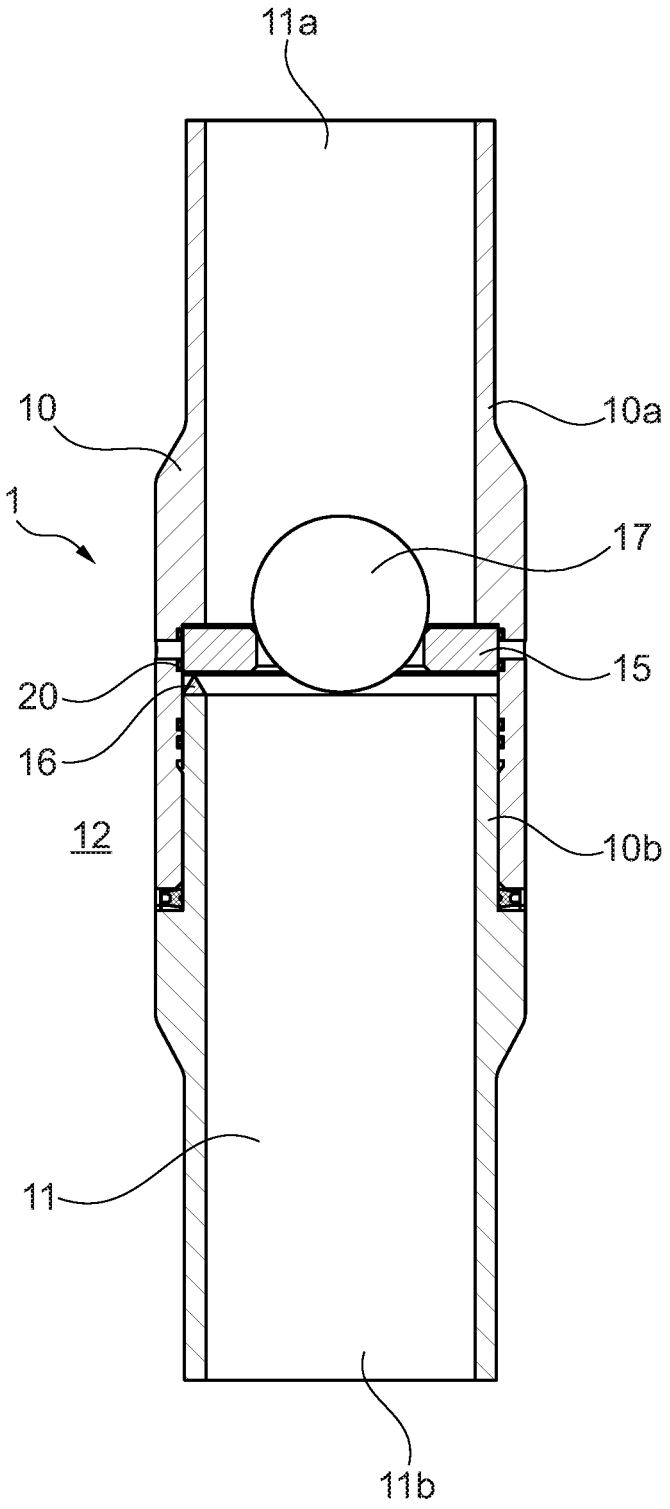

FIG. 10 shows a fourth embodiment of the invention. The housing 10 of the fourth embodiment of the well tool is basically similar to the housing of the previously embodiments. However, a sleeve in the same manner is not used. The well tool 1 comprising similar a housing 10 having a through channel 11 having a first end 11*a* and a second end 11*b*. The housing has an outside 12. In the housing, there are one or more radial ports 14 connecting the through channel 11 with the outside 12 of the housing 10. A crushable ball seat 15 is provided within the housing 10, together with a disintegrating means 16. The ball seat 15 is covering the ports 14. By creating a differential pressure over the ball seat 15 and the ball 17, the ball seat 15 can then be forced axially so that the ball seat 15 is broken by the disintegrating means 16. When the ball seat 15 is crushed, the ports 14 are open and communication can take place between the through channel 11 and the outside 12. When the ports 14 are open and the ball seat 16 is disintegrated, full and unrestricted flow can happen in the through bore 11.

In the fourth embodiment, the disintegrating means 16 comprises one or more pins protruding axially in the through channel 11 of the housing 10. Pressure is in similar way build up to force the ball seat 15 against the disintegrating means 16 to shatter the ball seat 15. As mentioned, the housing 10 may comprise a first and a second house part 10*a*, 10*b* connected to each other, The ball seat 15 can be located adjacent an internal end of the first house part 10*a* and the one or more pins of the disintegrating means 16 can protrude axially from an internal end of the second house part 10*b*. To prevent that the ball seat 15 is unintentionally shattered or broken, a ring shaped disk 20 can be placed adjacent the disintegrating means 16, wherein said ring shaped disk 20 is being arranged to break at a predetermined breaking pressure.

Figure 11A:
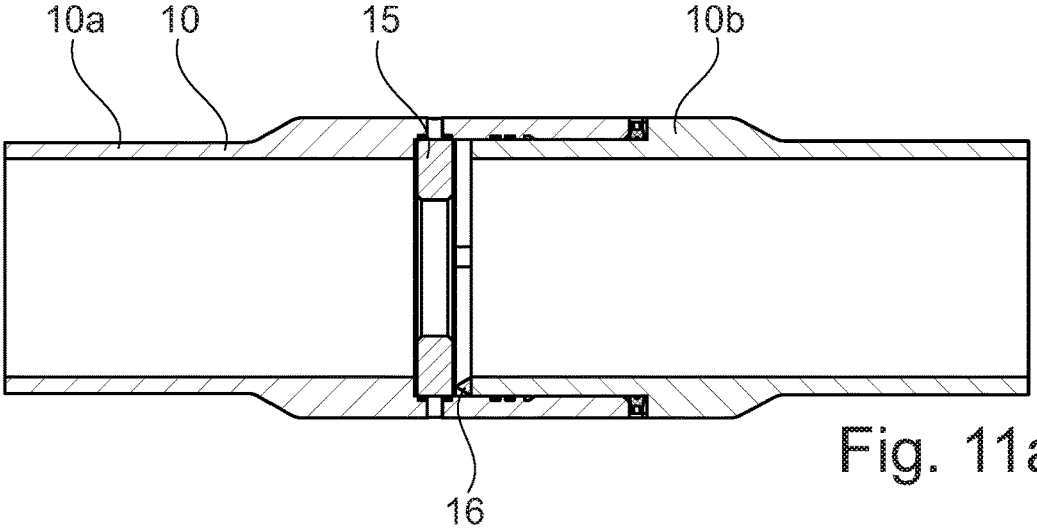
Figure 11B:
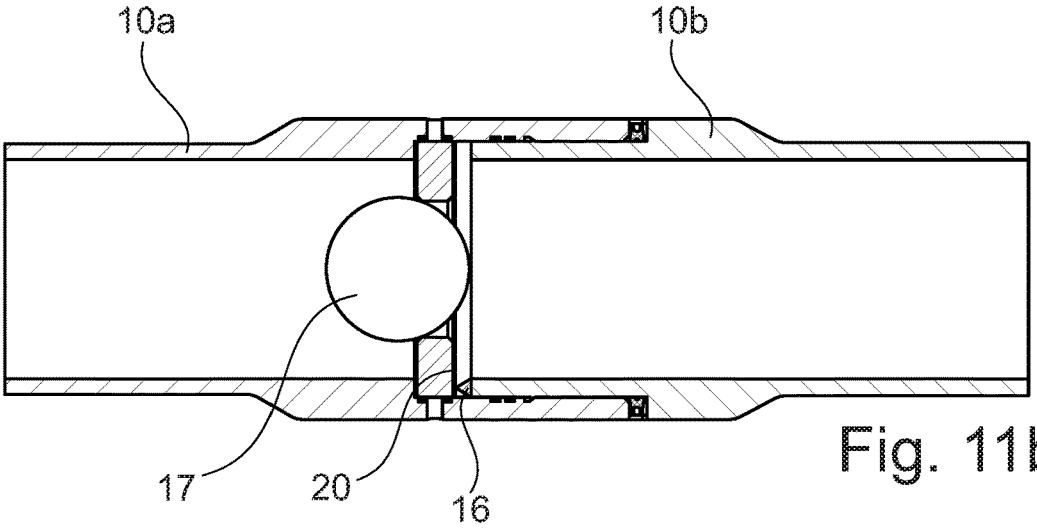
Figure 11C:
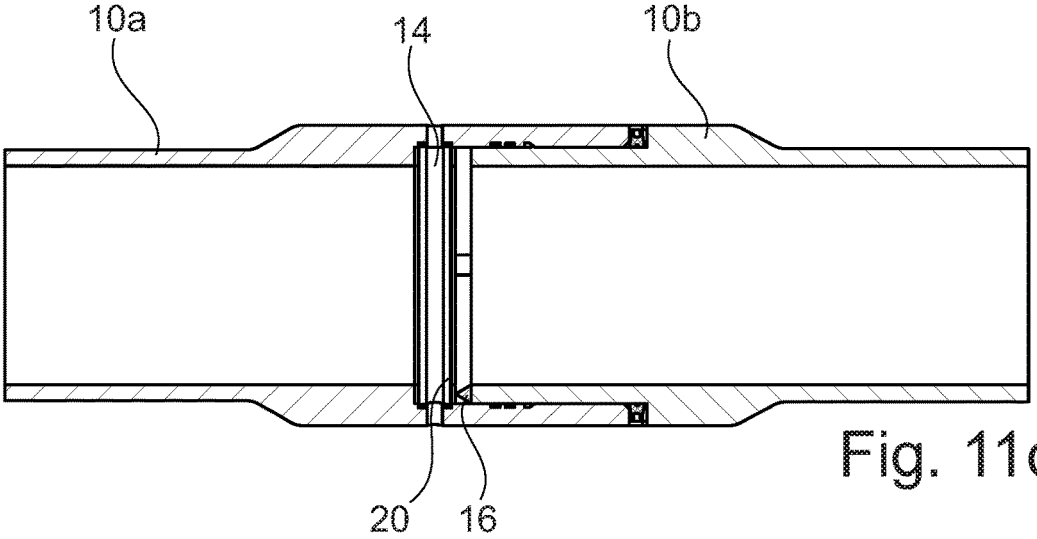

FIG. 11*a* shows the housing 10 being run in hole, and the ports 14 are closed by the ball seat 15. In FIG. 11*b*, the drop ball 17 has landed in the ball seat 15 and pressure is increased. When the pressure has increased sufficiently, the ring 20 breaks and the ball seat 15 is pushed against the disintegrating means 16 and shattered. FIG. 11*c* shows that the ball seat 15 is shattered and the ports 14 are open.

The fourth embodiment is particularly suited for opening the tubing 36, used for instance during tubing to annulus circulation for shifting from closed to open, typical for fracking applications, and as disclosed in relation to the third embodiment.

Figure 12:
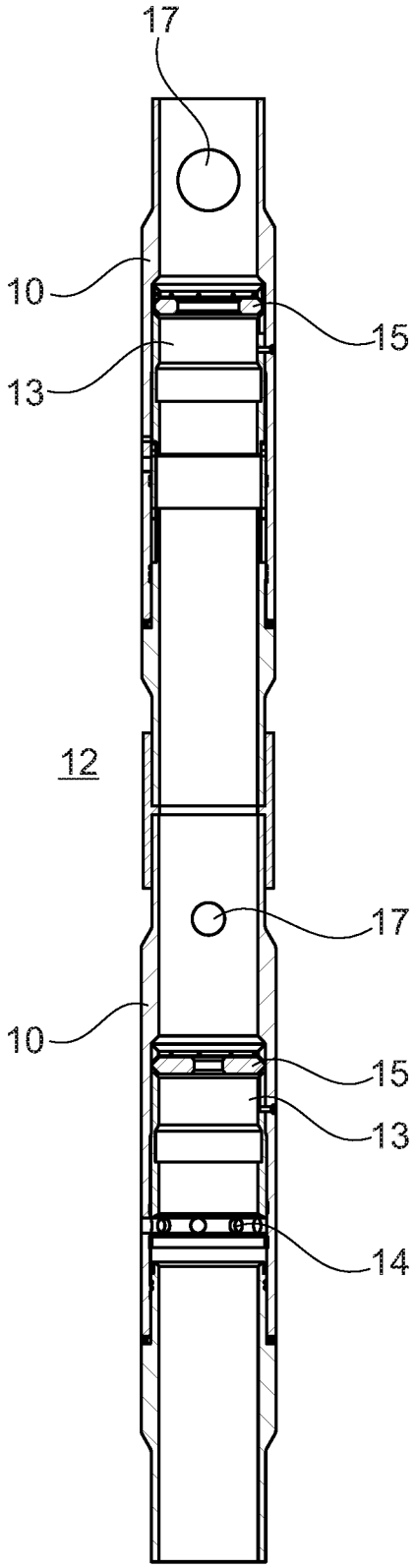

FIG. 12 shows a fifth embodiment of the invention. The well tool 1 comprises two housings 10 with one ball seat 15 in each housing with different internal diameters. This will allow the two ball seats 15 and sleeves 13 to be activated at different times to address separate actions. Each housing 10 is similar to the embodiments previously described. For example, by dropping a smaller drop ball 17, which can pass through the top ball seat 15 without shattering it, the lower ball seat 15 can be activated to close the lowers sleeve 13. A second and larger drop ball 17 can be dropped to land in the top ball seat 15 to activate the top sleeve 13.

Figure 13A:
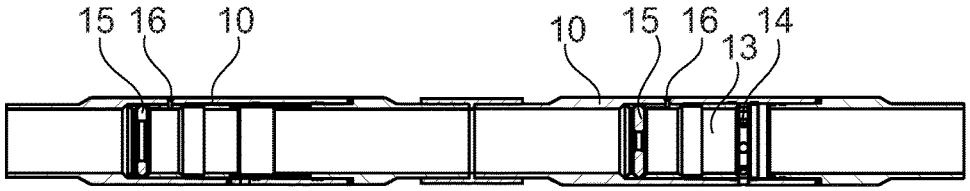
Figure 13B:
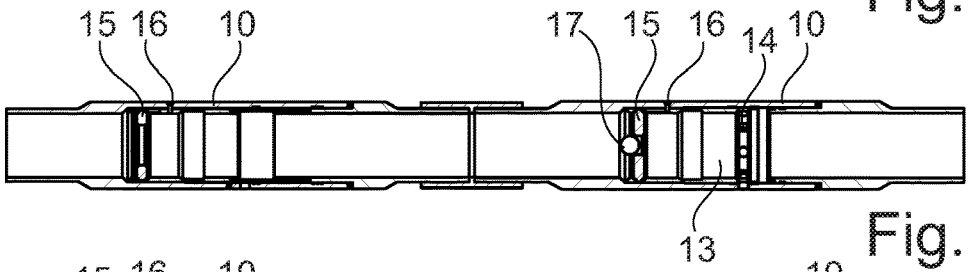
Figure 13C:
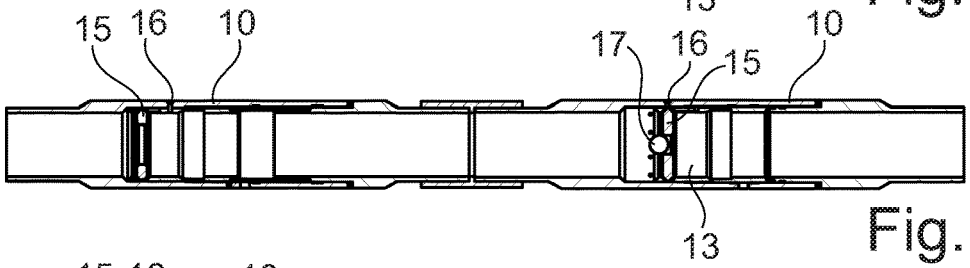
Figure 13D:
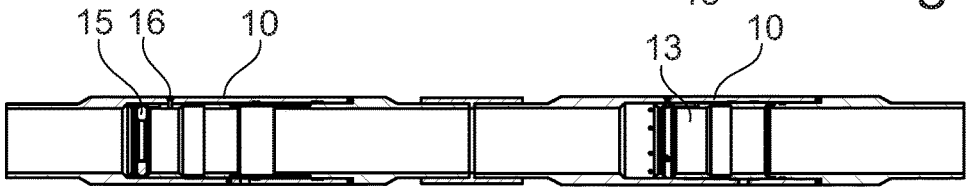

FIG. 13*a*-13*h* show operation of the fifth embodiment of the invention. FIG. 13*a* shows running the two housings 10 in the hole, with the top sleeve 13 closed and the lower sleeve 13 open. In FIG. 13*b*, the first drop ball 17 has landed in the lower ball seat 15 and after pressure build up the lower sleeve 13 is shifted axially to close the ports 14, as seen in FIG. 13*c*, and thereafter the ball seat 15 is shattered as seen in FIG. 13*d*.

Figure 13E:
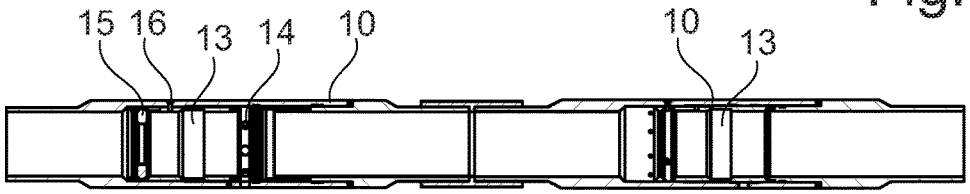
Figure 13F:
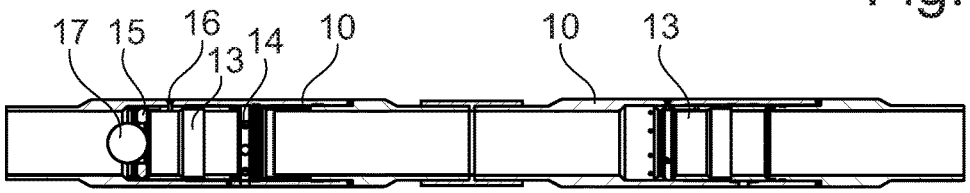
Figure 13G:
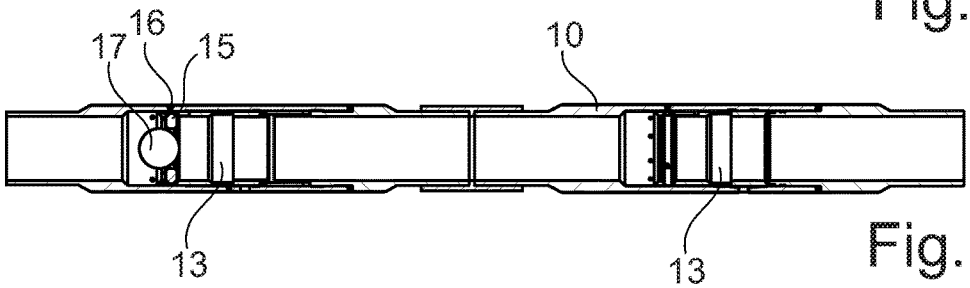
Figure 13H:
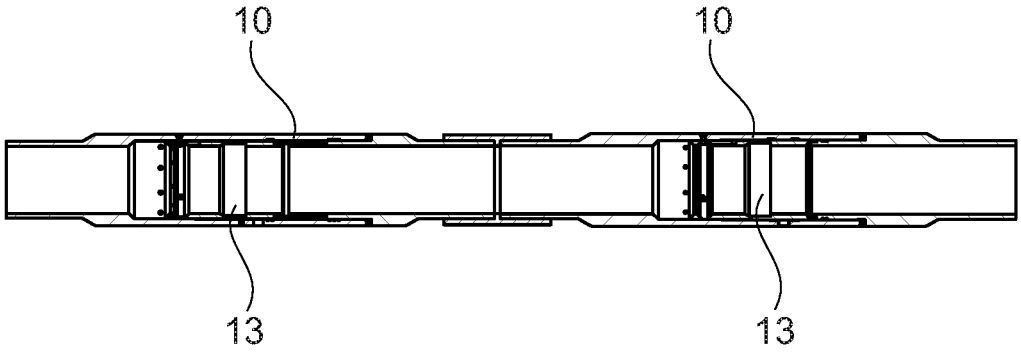

FIG. 13*e* shows pressure cycle annulus to open top sleeve 13. The second part of the operation can then start. The second larger drop ball 17 is received, as seen in FIG. 13*f*, and the top sleeve is shifted to closed position (FIG. 13*g*) to close the ports 14. FIG. 13*h* shows that the top ball seat 15 is shattered.

Figure 14A:
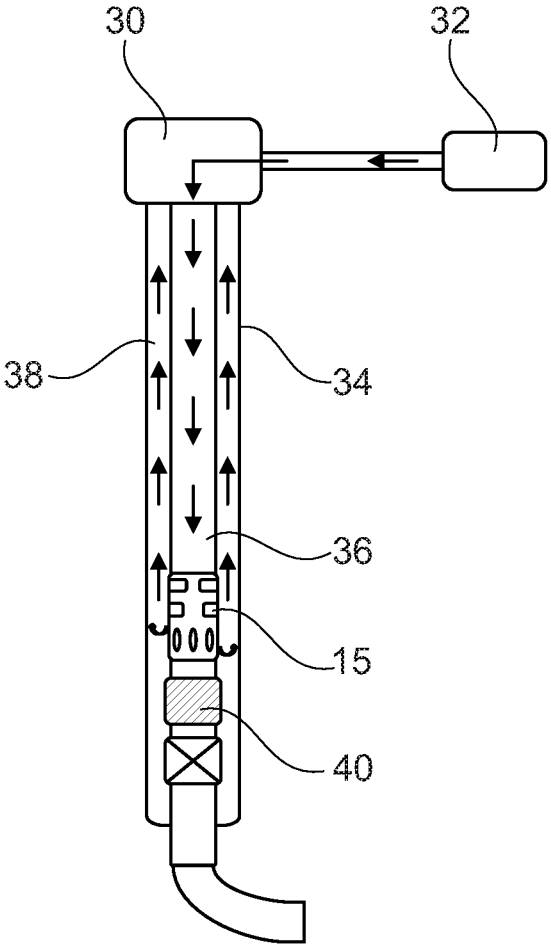
Figure 14B:
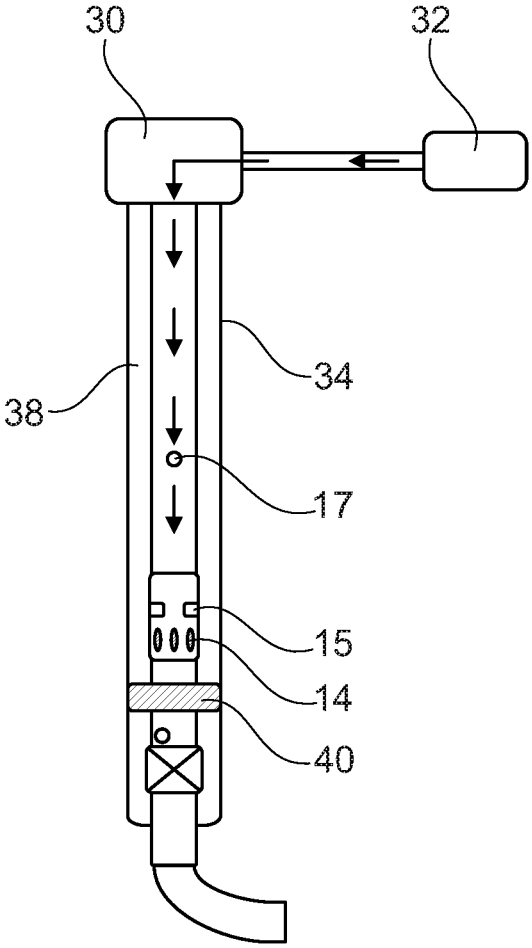

FIG. 14*a*-14*b* and 15*a*-15*b* show application of the fifth embodiment of the invention. FIG. 14*a*-14*b* shows the first part of the operation and 15*a*-15*b* shows the second part of the operation. Reference number 30 indicate the rig and reference number 32 indicate a pump.

FIG. 14*a* shows that the tubing 36 has been run into the hole 34 and fluid is being circulated between tubing 36 and annulus side 38. The ports 14 are open and the string will self fill. In FIG. 14*b*, the drop ball 17 has been dropped into the tubing 36 and flows with the fluid flow in the tubing, and the ball seat 15 is shattered and the sleeve 13 is closed. Packer 40 is set and test completion against deep barrier can be performed.

Figure 15A:
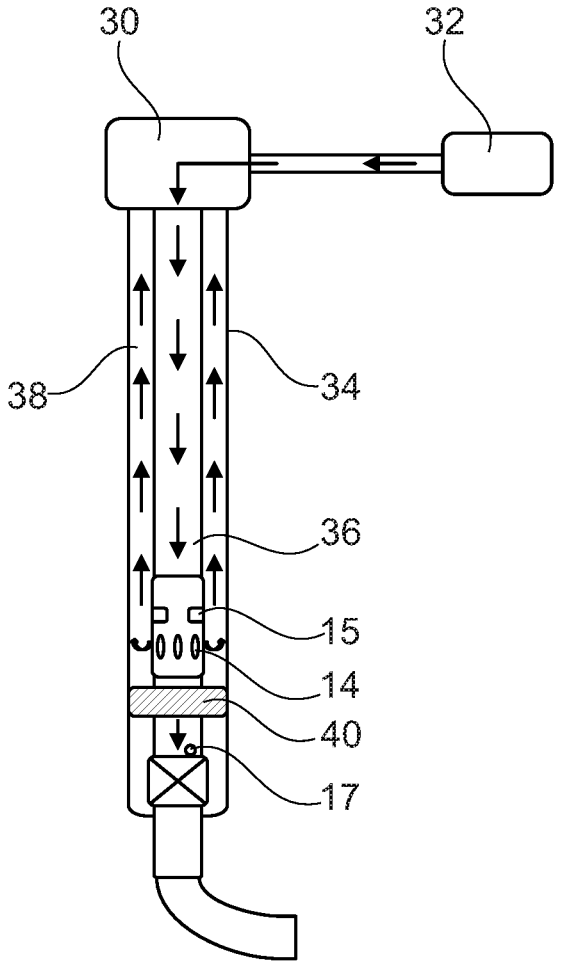
Figure 15B:
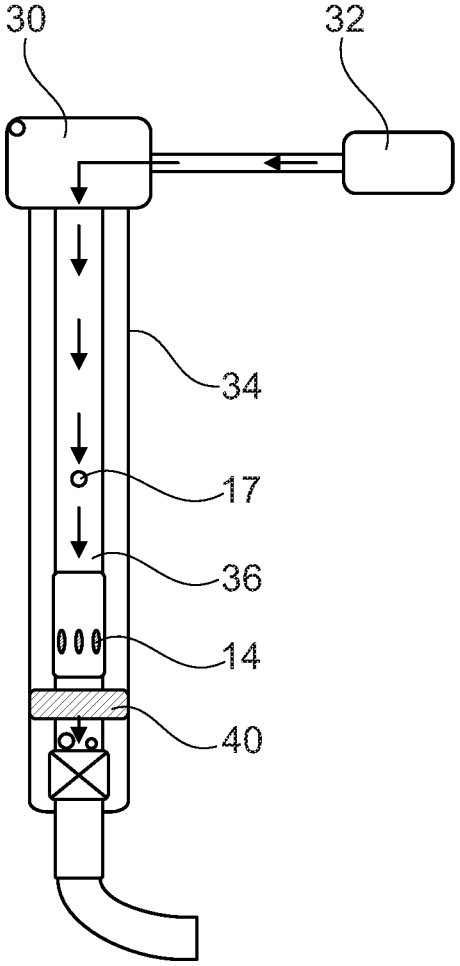

In FIG. 15*a* the pressure cycle annulus to open the top sleeve 13 is shown, and circulation to light fluid. The drop ball 17 is dropped, as shown in FIG. 15*b*, and the ball seat 15 is shattered and the top sleeve 13 is closed. Both top and lower sleeves 13 are not permanently closed.

The fifth embodiment is particularly suited for tubing to annulus multicycle, i.e. shifting from open to closed to open to closed, by for instance utilizing two crushable ball seats in different sizes.

Figure 16:
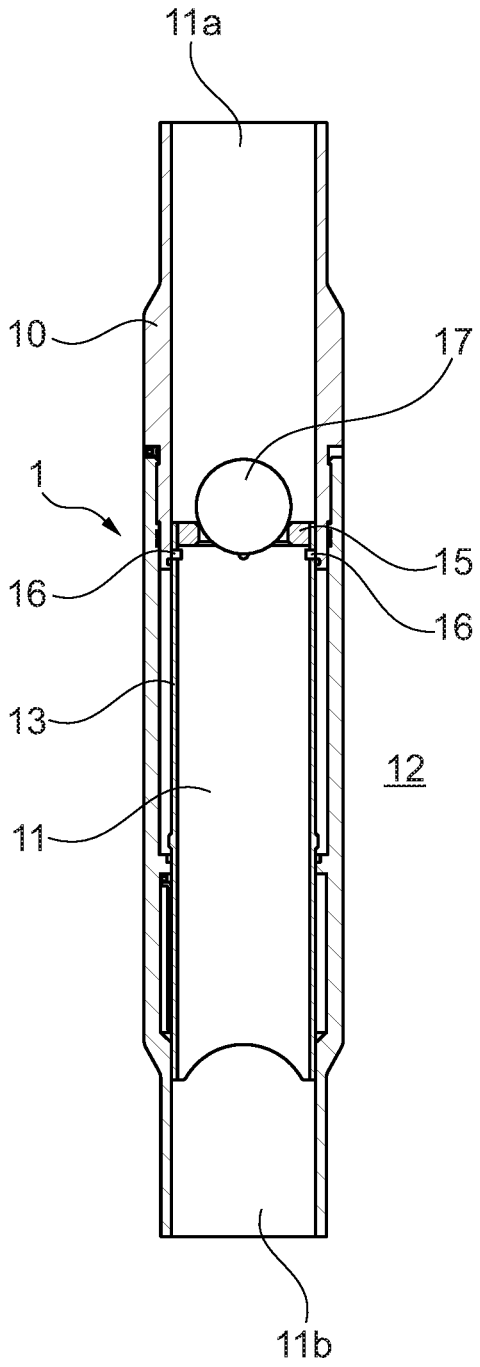

FIG. 16 shows a sixth embodiment of the invention. The well tool 1 comprises as previously disclosed a housing 10 having a through channel 11 having a first end 11*a* and a second end 11*b*. The house has an outside 12. A sleeve 13 is provided in the housing. A breakable ball seat 15 is provided at partially within the sleeve 13, together with a disintegrating (crushing) means 16. A flapper valve is provided in the annular space between housing 10 and the sleeve 13.

A flapper valve is a check valve that has a spring-loaded plate or flapper that may be pumped through, generally in the downhole direction, but closes if the fluid attempts to flow back through the drill string to the surface. This reverse flow might be encountered either due to a U-tube effect when the bulk density of the mud in the annulus is higher than that inside the drill pipe, or a well control event.

By creating a differential pressure over the ball seat 15 and the drop ball 17, the sleeve can then be axially pushed so that an activation device will release a retaining device holding the sleeve in place. The sleeve 13 will then move axially upwards and expose and place the flapper over the sleeve 13 end opening. After the above sequence is complete, the breakable ball seat 15 is broken by the disintegrating means 16. When the ball seat 15 is disintegrated, full and unrestricted flow can happen in the through bore 11.

Figure 17A:
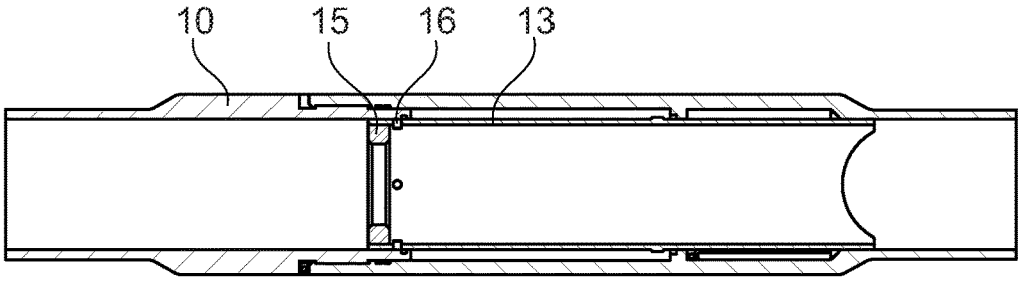
Figure 17B:
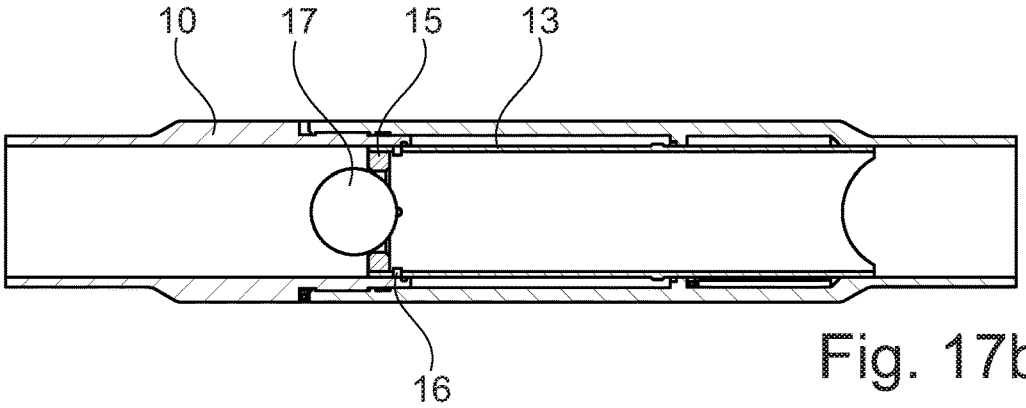
Figure 17C:
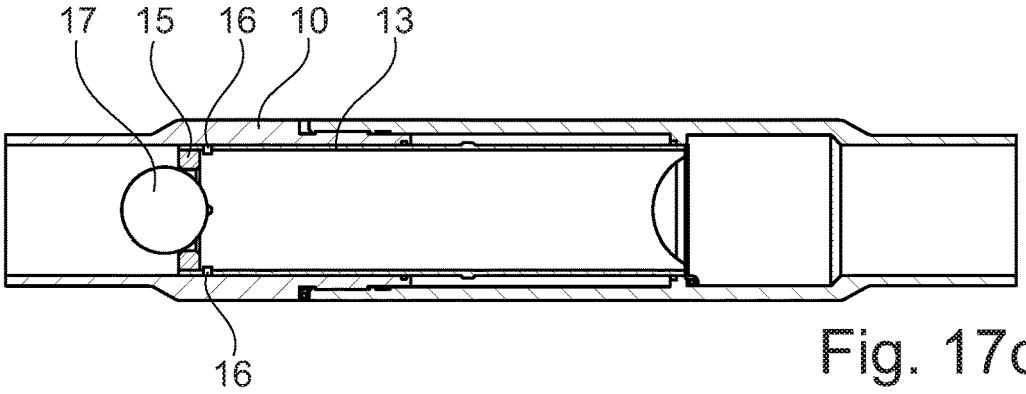
Figure 17D:
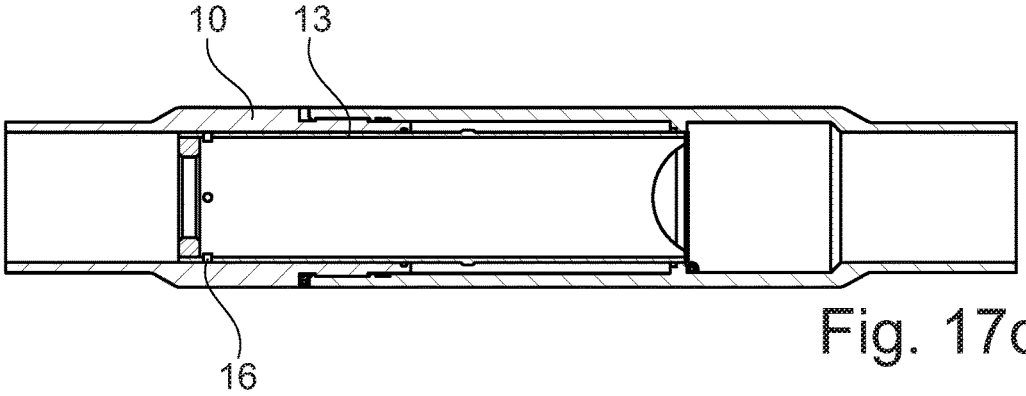
Figure 17E:
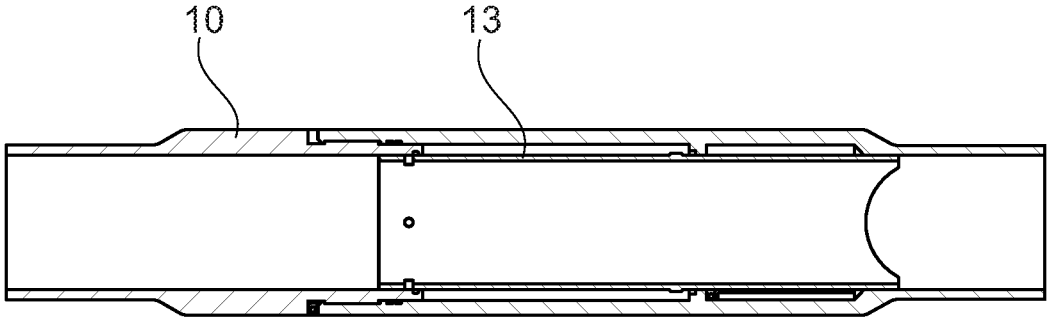

FIG. 17*a* shows that the tubing with the housing 10 is run in hole in open position. In FIG. 17*b*, the drop ball has landed in the ball seat 15. In FIG. 17*c*, pressure is increased and bleed off to allow a spring to close the flapper valve, and thereafter the ball seat 15 is shattered (FIG. 17*d*). FIG. 17*e* shows that pressure cycle can be applied to reopen the flapper valve.

Figure 18A:
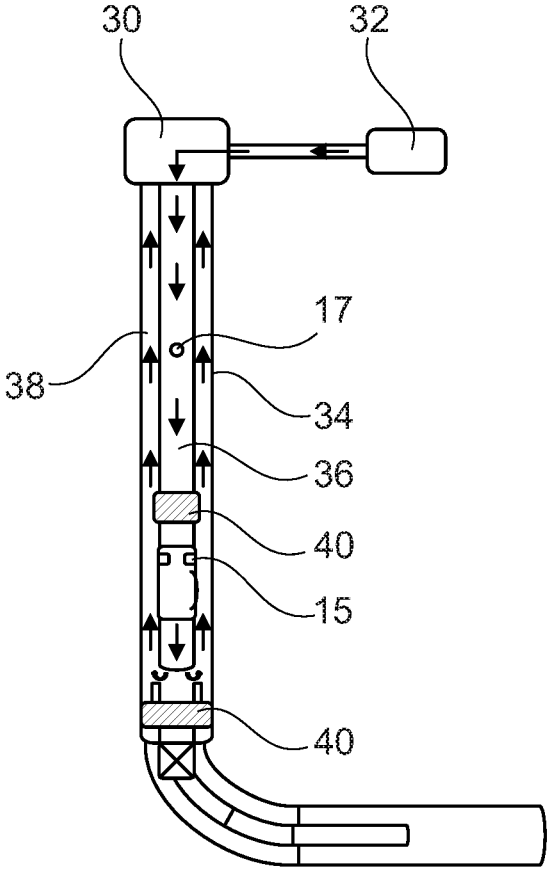
Figure 18B:
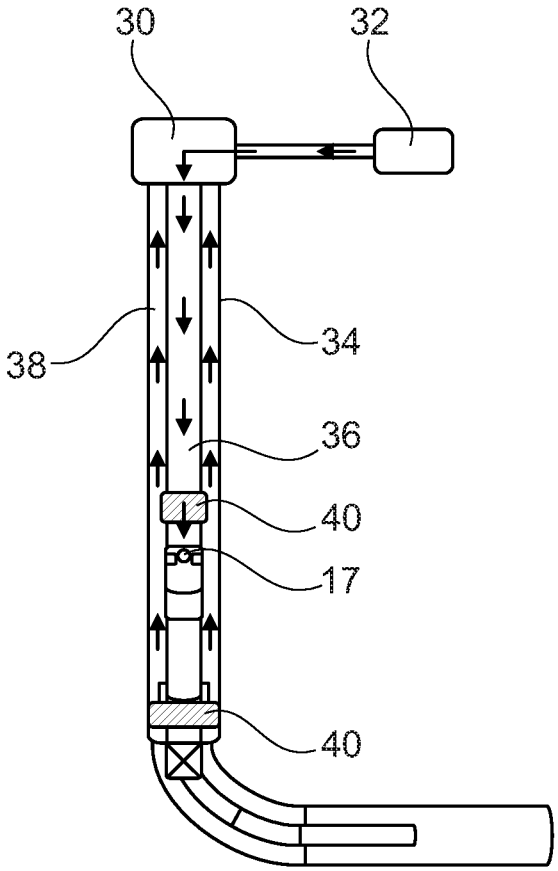

FIG. 18*a*-18*b* show application of the sixth embodiment of the invention. FIG. 18*a* shows that the tubing is run into the hole. Tubing will self fill with the flapper open. Tubing at TD (target depth) circulate, and the drop ball 17 is dropped to land on the ball seat 15. Pressure is thereafter built up to release flapper. In FIG. 18*b* production packer is set, and test well and production packer is performed. Flapper is closed and will hold pressure from bellow.

The sixth embodiment is particularly suited for shifting/activating flapper valve.

The invention claimed is:

1. A well tool device comprising:

a housing having a through channel with a first end and a second end, the housing further comprises a breakable ball seat, wherein a drop ball received in the ball seat partially or fully closes fluid communication in the through channel of the housing, wherein the breakable ball seat is made of brittle and/or tempered glass, wherein the ball seat is broken by a pressure build up in the housing forcing the ball seat against one or more disintegrating means, wherein the disintegrating means are provided as inside protrusions in the through channel, wherein the housing comprises resistance means holding a sleeve in place with the ball seat in place during pressure testing of the well, the resistance means comprises a counter and a release mechanism, and wherein the release mechanism is a retractable release piston embedded in the sleeve, which after the counter has counted a number of pressure pulses is released to allow movement of the sleeve with the ball seat.

2. Well tool device according to claim 1, wherein the sleeve is housing (10) comprises an axially movable sleeve, and the ball seat is seated in the sleeve.

3. Well tool device according to claim 1, wherein the sleeve comprises one or more longitudional slots for receipt of the inside protrusions of the disintegrating means.

4. Well tool device according to claim 1, wherein the breakable ball seat is donut shaped.

5. Well tool device according to claim 1, wherein said disintegrating means comprises one or more pins mounted inside the housing and which the protruding inwardly in the through channel.

6. Well tool device according to claim 1, wherein after the drop ball is received in the ball seat and fluid communication in the through channel of the housing is partially or fully closed, the sleeve is shifted axially in the housing by the pressure build up to close or open parts in the housing.

7. Well tool device according to claim 1, wherein the drop ball is dissolvable.

8. Well tool device according to claim 1, wherein said disintegrating means comprises one or more pins protruding inwardly on the inside of the sleeve, wherein the pressure build up forces the ball seat against the disintegrating means to shatter the ball seat.

9. Well tool device according to claim 1, wherein said disintegrating means comprises one or more pins protruding axially in the through channel of the housing, wherein the pressure build up forces the ball seat against the disintegrating means to shatter the ball seat.

10. Well tool device according to claim 9, wherein the housing comprises a first and a second house part connected to each other, and the ball seat is located adjacent an internal end of the first house part and the one or more pins of the disintegrating means protrude axially from an internal end of the second house part.

11. Well tool device according to claims 8 or 9, wherein a ring shaped disk is placed adjacent the disintegrating means, wherein the ring shaped disk being arranged to break at a predetermined breaking a pressure.

12. Well tool device according to claim 1, wherein the breakable ball seat is made of one piece of glass.

13. Well tool device according to claim 1, wherein the breakable ball seat is made of several pieces of glass.

14. Well tool device according to claim 13, wherein the pieces of glass are separated by an intermediate material layer other than glass.

15. Well tool device according to claim 14, wherein said material layer is a gasket.

16. Well tool device according to claim 1, wherein the resistance means also comprises shear pins or a shear ring holding the sleeve with the ball seat in place, and wherein the shear pins or ring have a shear resistance higher than a test pressure.

17. Well tool device according to claim 1, wherein the counter is placed on the pressurized side of the ball seat and the retractable release prison is placed on the non-pressurized side of the ball seat, and said counter and the retractable release piston are connected by a pressure line to each other.

18. A well tool device comprising a housing having a through channel with a first end and a second end, the housing further comprises a breakable ball seat, wherein a drop ball received in the ball seat partially or fully closes fluid communication in the through channel of the housing, wherein the breakable seat is made of brittle and/or tempered glass, wherein the ball seat is broken by a pressure build up in the housing forcing the ball seat against one or more disintegrating means, wherein the disintegrating means are provided as inside protrusions in the through channel, wherein the housing comprises resistance means holding a sleeve with the ball seat in place during pressure testing of the well, the resistance means comprises a counter placed on the pressurized side of the ball seat and a release mechanism being a retractable release piston embedded in the sleeve and placed on the non-pressurized side of the ball seat, wherein the counter and the retractable release in piston are connected to each other by a pressure line, and wherein after the counter has counted a number of pressure pulses the retractable release piston is released to allow movement of the sleeve with the ball seat.

19. A well tool comprising:

a housing with a through channel with a first end and a second end;

a breakable ball seat disposed in the housing, wherein the ball seat is made of brittle and/or tempered glass;

one or more disintegrating means provided as inside protrusions in the through channel, wherein the ball seat is broken by a pressure build up in the housing forcing the ball seat against the disintegrating means;

a drop ball which, when received in the ball seat, partially or fully closes fluid communication in the through housing of the housing; and a resistance means in the housing for holding a sleeve in place with the ball seat during pressure testing of the well, wherein the resistance means comprises:

a counter disposed on the pressurized side of the ball seat and a release piston embedded in the sleeve and placed on the non-pressurized side of the ball seat, wherein the counter and retractable release piston are connected to each other by a pressure line and wherein after the counter has counted a number of pressure pulses the release piston is released to allow for movement of the sleeve with the ball seat.

* * * * *